US012404755B1

(12) United States Patent
Smith et al.

(10) Patent No.: US 12,404,755 B1
(45) Date of Patent: Sep. 2, 2025

(54) COMPARTMENTALIZED HYDRAULIC FRACTURING SYSTEM

(71) Applicant: Typhon Technology Solutions (U.S.), LLC, The Woodlands, TX (US)

(72) Inventors: Jason David Smith, Conroe, TX (US); Matthew James Vahsholtz, The Woodlands, TX (US); Michael Bateman, New Waverly, TX (US); Johnny Martin, Columbia, MS (US)

(73) Assignee: Typhon Technology Solutions (U.S.), LLC, The Woodlands, TX (US)

( * ) Notice: Subject to any disclaimer, the term of this patent is extended or adjusted under 35 U.S.C. 154(b) by 0 days.

(21) Appl. No.: 19/173,364

(22) Filed: Apr. 8, 2025

Related U.S. Application Data

(63) Continuation of application No. 19/076,125, filed on Mar. 11, 2025.

(60) Provisional application No. 63/672,979, filed on Jul. 18, 2024.

(51) Int. Cl.

| | |
|---|---|
| ***E21B 43/26*** | (2006.01) |
| ***E21B 34/16*** | (2006.01) |
| ***E21B 43/14*** | (2006.01) |

(52) U.S. Cl.
CPC ..... *E21B 43/26* (2013.01); *E21B 34/16* (2013.01); *E21B 43/14* (2013.01)

(58) Field of Classification Search
CPC ..... E21B 43/2607; E21B 43/26; E21B 43/14; E21B 34/16
See application file for complete search history.

(56) References Cited

FOREIGN PATENT DOCUMENTS

CA 2943275 C * 10/2020 ..... E21B 43/2607

* cited by examiner

*Primary Examiner* — Zakiya W Bates
(74) *Attorney, Agent, or Firm* — Fenwick & West LLP

(57) ABSTRACT

A compartmentalized hydraulic fracturing (frac) system may include a mono line configured to carry frac fluid into a well. The system may include a plurality of zones, each zone comprising: a set of one or more frac pumps each configured to pump frac fluid into the mono line, an isolation valve configured to control the flow of frac fluid between the set of frac pumps and the mono line; and a bleed valve configured to release pressurized frac fluid from the set of frac pumps when in an open position. The system may include partition walls between the plurality of zones. The system may include a control system configured to deactivate or reactivate a zone of the plurality of zones by controlling the set of frac pumps, the isolation valve, and the bleed valve of the zone.

20 Claims, 15 Drawing Sheets

COMPARTMENTALIZED HYDRAULIC FRACTURING SYSTEM

CROSS REFERENCE TO RELATED APPLICATION

This application is a continuation of U.S. patent application Ser. No. 19/076,125, "COMPARTMENTALIZED HYDRAULIC FRACTURING SYSTEM", filed on Mar. 11, 2025, which claims priority to U.S. Provisional Patent Application Ser. No. 63/672,979, "COMPARTMENTALIZED HYDRAULIC FRACTURING SYSTEM," filed on Jul. 18, 2024, the subject matter of which are incorporated herein by reference in their entirety.

TECHNICAL FIELD

This disclosure relates generally to hydraulic fracturing (frac) systems, and more specifically, to systems for minimizing downtime for fracturing operations.

BACKGROUND

Hydraulic fracturing, or fracking, is a process utilized in the extraction of oil and natural gas stored in deep geologic formations. Fracking methodology involves the injection of high-pressure fluids into a wellbore to create small fractures and fissures in the rock formation. This process enables natural gas or oil to flow out of the well more freely. This is typically achieved using powerful hydraulic fracturing pump trailers, which generate and maintain the immense pressures required for the operation.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

DETAILED DESCRIPTION

Figure 1:
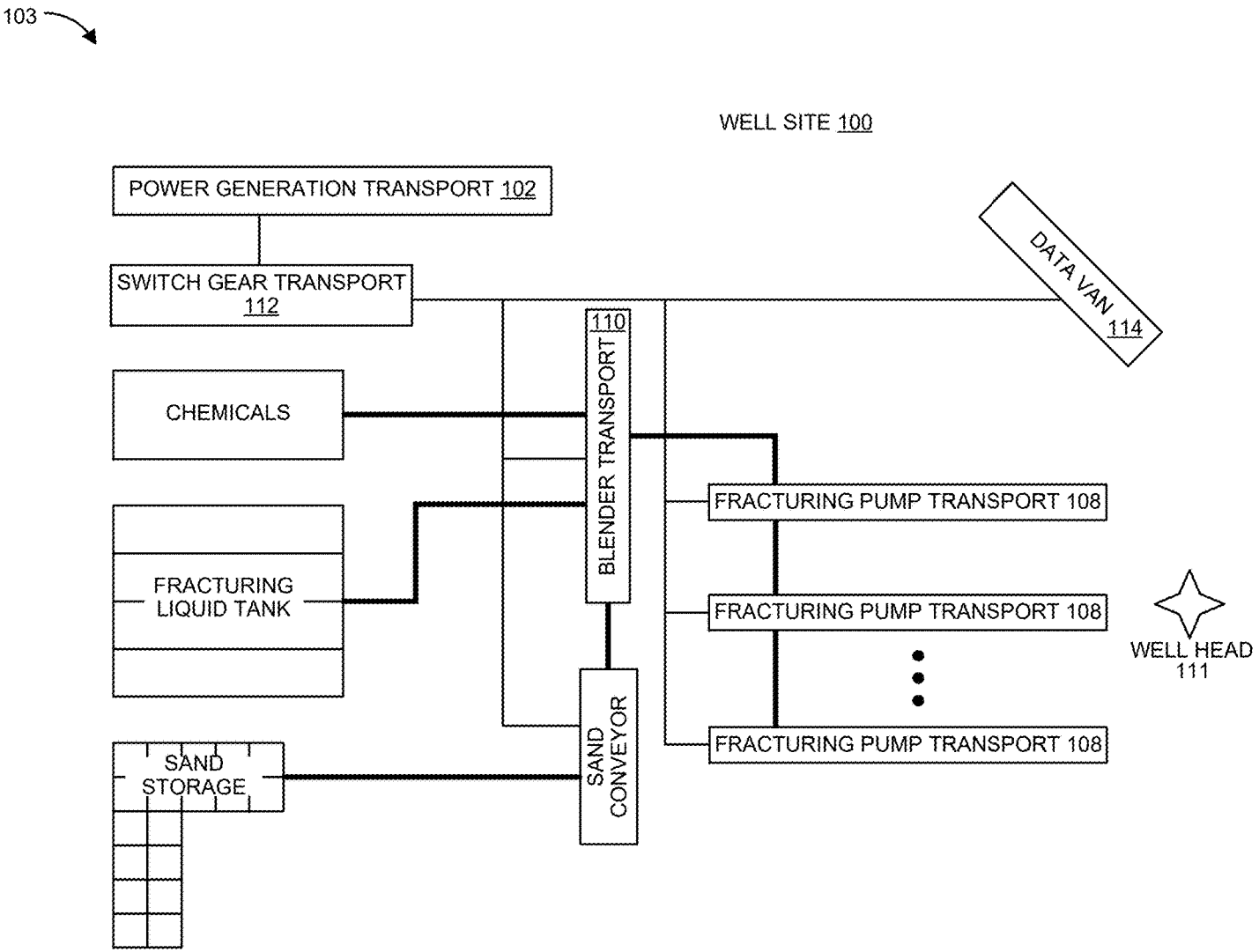
FIG. 1 is a schematic diagram of a mobile hydraulic fracturing system operating at a well site, in accordance with one or more embodiments.

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

In the following description, for purposes of explanation, numerous specific details are set forth to provide a thorough understanding of the inventive concept. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" or "another embodiment" means that a particular feature, structure, or characteristic described in connection with the embodiment is included in at least one embodiment of the invention, and multiple references to "one embodiment" or "an embodiment" or "another embodiment" should not be understood as necessarily all referring to the same embodiment.

The terms "a," "an," and "the" are not intended to refer to a singular entity unless explicitly so defined but include the general class of which a specific example may be used for illustration. The use of the terms "a" or "an" may therefore mean any number that is at least one, including "one," "one or more," "at least one," and "one or more than one." The term "or" means any of the alternatives and any combination of the alternatives, including all the alternatives, unless the alternatives are explicitly indicated as mutually exclusive. The phrase "at least one of" when combined with a list of items, means a single item from the list or any combination of items in the list. The phrase does not require all the listed items unless explicitly so defined.

As used herein, the term "transport" refers to any transportation assembly, including, but not limited to, a trailer, truck, skid, and/or barge used to transport heavy structures, such as a gas turbine, a generator, a power generation system, an air handling system, and the like.

As used herein, the term "trailer" refers to a transportation assembly used to transport heavy structures, such as a gas turbine, a generator, a power generation system, an air handling system, and the like, that can be attached and/or detached from a transportation vehicle used to pull or move the trailer. In one embodiment, the trailer may include the mounts and manifold systems to connect the trailer to other equipment.

Configuration Overview

Hydraulic fracturing often includes using powerful hydraulic fracturing pumps ("frac pumps"), which may generate and maintain immense pressures. A challenge associated with hydraulic fracturing is the inherent risk posed by these high-pressure systems. The area immediately surrounding the frac pumps, often referred to as the "red zone," may be particularly hazardous due to the potential for leaks, ruptures, or equipment failures. The immense pressures within the system can transform even small components into dangerous projectiles, creating a substantial risk of injury or even fatality for personnel working in the vicinity.

To mitigate these risks, stringent safety protocols are enforced in fracking operations. These protocols typically require that the entire fracturing process be halted whenever maintenance or repairs are desired (e.g., needed) on equipment within the red zone. This allows personnel to enter the area safely, perform the desired work, and then vacate before operations resume. However, this practice may result in significant downtime, which may lead to substantial financial losses due to reduced production, increased labor costs, and potential contractual penalties. Thus, the industry can benefit from solutions that help address the safety risks associated with high-pressure fracking systems without incurring the costly downtime of traditional maintenance procedures.

To overcome the above problems, some embodiments described herein pertain to a compartmentalized frac system that strategically divides a frac fleet including several frac pump trailers or frac pumps into multiple zones to increase pump efficiency and reduce downtime. Each zone (also "compartment") may include at least one frac pump trailer and each frac pump trailer may include at least one frac pump. For a service event (e.g., due to a component failure or scheduled maintenance), service personnel and/or a control system may selectively deactivate (also "shut down" or "taken offline") a particular zone while the other zones remain operational. After deactivating the zone (e.g., including deenergizing equipment within the zone), service personnel can (e.g., safely) enter the zone while the other zones continue to pump high-pressure frac fluid downhole at the desired flow rate or pressure. "High-pressure" fluid may refer to fluid downstream of a pump or pump trailer. Example high-pressures include pressures in the range of 300-15,000 PSI (pounds per square inch) or even higher, such as 20,000 PSI or greater. Examples of high-pressure systems include the flow line iron and well head equipment (which are downstream of the frac pumps). Similarly, "low-pressure" fluid may refer to fluid upstream of a pump or pump trailer. Example low-pressures include pressures in the range of 0-300 PSI, and examples of low pressure systems include the water transfer, blender, and piping supply systems (that are upstream of the frac pumps).

The compartmentalized frac system may enable remote deactivation (e.g., including de-energization) or reactivation (e.g., including re-energization) of the selected zone where a frac pump (e.g., on which maintenance or failure operations need to be performed) is located. The system may include components for isolating, bleeding, priming, or any combination thereof, each zone and sensors to measure sensor data from each zone to remotely deactivate or reactivate the selected zone. A deactivated zone may enable service personnel to enter the zone (e.g., safely), and perform the desired service (e.g., failure correction work). After the service work is complete, the compartmentalized frac system may reactivate the zone by ramping pressure back up from the zone and restart sending high-pressure frac fluid downhole from that zone. Other zones may continue to send high-pressure frac fluid downhole (e.g., at an increased flow rate) to maintain target downhole pressure and rate while a zone being serviced is offline.

The compartmentalized frac system may include components to turn off the (e.g., high-voltage) power line feeding power to the electric motors driving the frac pumps on the one or more pump trailers located in the selected zone being deactivated. The system may also include partition walls between zones to prevent a pressure leak or other hazard from the red zone from harming personnel working in an adjacent deactivated zone.

The compartmentalized frac system (e.g., via a control system) may selectively and individually adjust rates (or pressures) across zones so that a target downhole rate (or pressure) is maintained (e.g., within a threshold range that depends on operations of the well site (e.g., within +/−2000 psi of the treating pressure or +/−7 bbls (barrels per second) of down hole rate)) even when one or more zones are temporarily deactivated for service. The system may be configured to ramp up or ramp down the rate (or pressure) from one or more of the other zones as a selected zone is being deactivated and when it is being reactivated (also referred to as "brought back online"). The system may enable automation or semi-automation of the frac system. For example, upon detection of a service event (e.g., a failure event) in a particular zone, the system may autonomously or semi-autonomously take steps to deactivate the zone while ramping up the flow rate (or pressure) from one or more of the other zones to maintain downhole rate (or pressure). The system may notify an operator when a zone is fully deactivated and ready for entry by service personnel to perform the desired work.

Other aspects include components, devices, systems, improvements, methods, processes, applications, computer readable mediums, and other technologies related to any of the above.

Example Mobile Hydraulic Fracturing System

FIG. 1 is a schematic diagram of a mobile hydraulic fracturing system 103 operating at a well site 100, in accordance with one or more embodiments. The well site 100 comprises a wellhead 111 (e.g., frac pad including multiple wells) and the mobile fracturing system 103 (e.g., hydraulic fracturing fleet, frac fleet or system). Generally, the mobile fracturing system 103 may perform fracturing operations to complete a well and/or transform a drilled well into a production well. For example, the well site 100 may be a site where operators are in the process of drilling and completing a well. Operators may start the well completion process (e.g., well completion operation) after drilling, running production casing, and cementing within the wellbore. The operators may also insert a variety of downhole tools into the wellbore and/or as part of a tool string used to drill the wellbore. After the operators drill the well to a certain depth, a horizontal portion of the well may also be drilled and subsequently encased in cement. The operators may subsequently remove the rig, and the mobile fracturing system 103 may be moved onto the well site 100 to perform the well completion operation (e.g., fracturing operation) that forces relatively high-pressure fracturing fluid through the wellhead 111 into subsurface geological formations to create fissures and cracks within the rock. The mobile fracturing system 103 may be moved off the well site 100 once the operators complete the well completion operation. Typically, the well completion operation for the well site 100 may last several days and even up to multiple months.

In one or more embodiments, the mobile fracturing system 103 may comprise a power generation transport 102 (e.g., mobile source of electricity; power generation system; turbine-electric generator transport; inlet and exhaust transport) configured to generate electricity by converting hydrocarbon fuel, such as natural gas, obtained from one or more sources (e.g., a producing wellhead) at the well site 100, from a remote offsite location, and/or another relatively convenient location near the power generation transport 102. That is, the mobile fracturing system 103 may utilize the power generation transport 102 as a power source that burns cleaner while being transportable along with other fracturing equipment. The generated electricity from the power generation transport 102 may be supplied to fracturing equipment to power fracturing operations at one or more well sites, or to other equipment in various types of applications requiring mobile electric power generation.

The power generation transport 102 may be implemented as a single-trailer power generation transport. In one or more embodiments, the power generation transport 102 may be implemented using two or more transports, and components of the power generation transport 102 may be arranged on the two or more transports in any reasonable manner. For example, the power generation transport 102 may be implemented using a two-transport design in which a first transport may comprise a turbine (e.g., gas turbine) and a generator, and a second transport may comprise an air filter box providing filtered combustion air for the turbine, and an exhaust stack that securely provides an exhaust system for combustion exhaust air from the turbine. As another example, the power generation transport 102 may be implemented using a three-transport design in which a first transport may include a gas turbine and an exhaust stack, a second transport may include a generator, and a third transport may include an air handling system that provides filtered intake air for combustion by the turbine. Different configurations (single-trailer, dual-trailer, or three-trailer configurations) of the power generation transport 102 are described in detail in U.S. Pat. No. 9,534,473, issued Jan. 3, 2017, to Jeffrey Morris et al and entitled "Mobile Electric Power Generation for Hydraulic Fracturing of Subsurface Geological Formations" (describing a dual-trailer configuration); U.S. Pat. No. 11,434,763, issued Sep. 6, 2022, to Jeffrey Morris et al and entitled "Single-Transport Mobile Electric Power Generation" (describing a single-trailer configuration); U.S. Pat. No. 11,512,632, issued Nov. 29, 2022, to Jeffrey Morris et al and entitled "Single-Transport Mobile Electric Power Generation" (describing a single-trailer configuration); and U.S. application Ser. No. 17/732,280, filed Apr. 28, 2022, by Jeffrey Morris et al and entitled "Mobile Electric Power Generation System" (describing a three-trailer configuration), each of which is herein incorporated by reference in its entirety.

Although not shown in FIG. 1, the power generation transport or system 102 may include a variety of equipment for mobile electric power generation including a gas conditioning skid, a black start generator, a power source (e.g., gas turbine), a power source air inlet filter housing, a power source inlet plenum, a power source exhaust collector, an exhaust coupling member, a power source exhaust stack, a gearbox, a generator shaft, a generator, a generator air inlet filter housing, a generator ventilation outlet, a generator breaker, a transformer, a starter motor, and a control system. Other components on the power generation transport 102 may include a turbine lube oil system, a fire suppression system, a generator lube oil system, and the like.

In one or more embodiments, the power source may be a gas turbine. In another embodiment, power source may be another type of power source (e.g., diesel engine, internal combustion engine). The gas turbine may generate mechanical energy (e.g., rotation of a shaft) from a hydrocarbon fuel source, such as natural gas, liquefied natural gas, condensate, and/or other liquid fuels. For example, a shaft of the gas turbine may be connected to the gearbox and the generator such that the generator converts the supplied mechanical energy from the rotation of the shaft of the gas turbine to produce electric power. The gas turbine may be a commercially available gas turbine such as a General Electric NovaLT5 gas turbine, a Pratt and Whitney gas turbine, or any other similar gas turbine. The generator may be a commercially available generator such as a Brush generator, a WEG generator, or other similar generator configured to generate a compatible amount of electric power. For example, the combination of the gas turbine, the gearbox, and the generator within power generation transport 102 may generate electric power from a range of at least about 1 megawatt (MW) to about 60 MW (e.g., 5.6 MW, 32 MW, or 48 MW). Other types of gas turbine/generator combinations with power ranges greater than about 60 MW or less than about 1 MW may also be used depending on the application requirement.

In addition to the power generation transport 102, the mobile fracturing system 103 may include a switch gear transport 112, at least one blender transport 110, at least one data van 114, and one or more fracturing pump transports 108 that deliver fracturing fluid through the wellhead 111 to the subsurface geological formations. The switch gear transport 112 may receive electricity generated by the power generation transport 102 via one or more electrical connections. In one embodiment, the switch gear transport 112 may use 13.8 kilovolts (KV) electrical connections to receive power from the power generation transport 102. The switch gear transport 112 may transfer the electricity received from the power generation transport 102 to electrically connected fracturing equipment of the mobile fracturing system 103. The switch gear transport 112 may comprise a plurality of electrical disconnect switches, fuses, transformers, and/or circuit protectors to protect the fracturing equipment. In some embodiments, switch gear transport 112 may be configured to step down a voltage received from the power generation transport 102 to one or more lower voltages to power the fracturing equipment.

Each fracturing pump transport 108 may receive electric power from the switch gear transport 112 to power a prime mover. The prime mover converts electric power to mechanical power for driving one or more fracturing pumps of the fracturing pump transport 108. In one embodiment, the prime mover may be a dual shaft electric motor that drives two different frac pumps mounted to each fracturing pump transport 108. Each fracturing pump transport 108 may be arranged such that one frac pump is coupled to opposite ends of the dual shaft electric motor and avoids coupling the pumps in series. By avoiding coupling the pump in series, fracturing pump transport 108 may continue to operate when either one of the pumps fails or has been removed from the fracturing pump transport 108. Additionally, repairs to the pumps may be performed without disconnecting the system manifolds that connect the fracturing pump transport 108 to other fracturing equipment within the mobile fracturing system 103 and the wellhead 111. The fracturing pump transport 108 may implement (in whole or in part) a system for predicting frac pump component life intervals and setting a continuous completion event for a well completion design.

The blender transport 110 may receive electric power fed through the switch gear transport 112 to power a plurality of electric blenders. In one or more embodiments, the blender transport 110 may function independently from the switch gear transport 112 and the power generation transport 102 and be powered by other means such as a diesel engine or a natural gas reciprocating engine. A plurality of prime movers may drive one or more pumps that pump source fluid and blender additives (e.g., sand) into a blending tub, mix the source fluid and blender additives together to form fracturing fluid, and discharge the fracturing fluid to the fracturing pump transports 108. In one embodiment, the electric blender may be a dual configuration blender that comprises electric motors for the rotating machinery that are located on a single transport. In another embodiment, a plurality of enclosed mixer hoppers may be used to supply the proppants and additives into a plurality of blending tubs.

The data van 114 may be part of a control system (e.g., a control network system), where the data van 114 acts as a control center configured to (e.g., remotely) monitor and provide operating instructions to remotely operate the evaporation system 101, the blender transport 110, the power generation transport 102, the fracturing pump transports 108, and/or other fracturing equipment within the mobile fracturing system 103. For example, the data van 114 may implement (in whole or in part) the control system for managing one or more heat transfer (e.g., air-to-liquid heat transfer, or liquid-to-air heat transfer) operations according to the present disclosure. In one embodiment, the data van 114 may communicate with the variety of fracturing equipment using a control network system that has a ring topology (or star topology). A ring topology may reduce the amount of control cabling used for fracturing operations and increase the capacity and speed of data transfers and communication.

Other fracturing equipment shown in FIG. 1, such as fracturing liquid (e.g., water) tanks, chemical storage of chemical additives, hydration unit, sand conveyor, and sandbox storage are known by persons of ordinary skill in the art, and therefore are not discussed in further detail. In one or more embodiments of the mobile fracturing system 103, one or more of the other fracturing equipment shown in FIG. 1 may be configured to receive power generated from the power generation transport 102. The control network system for the mobile fracturing system 103 may remotely synchronize and/or slave the electric blender of the blender transport 110 with the electric motors of the fracturing pump transports 108.

Example Compartmentalized Fracturing Systems

Compartmentalized frac systems are frac systems (e.g., 103) with components organized into individual zones. A compartmentalized frac system may include components for isolating, bleeding, and/or priming each zone individually, thus enabling service work to be performed on a zone that is taken offline while other zones remain operational. This modular approach enhances the flexibility, control, and reliability of a frac system process.

Figure 2A:
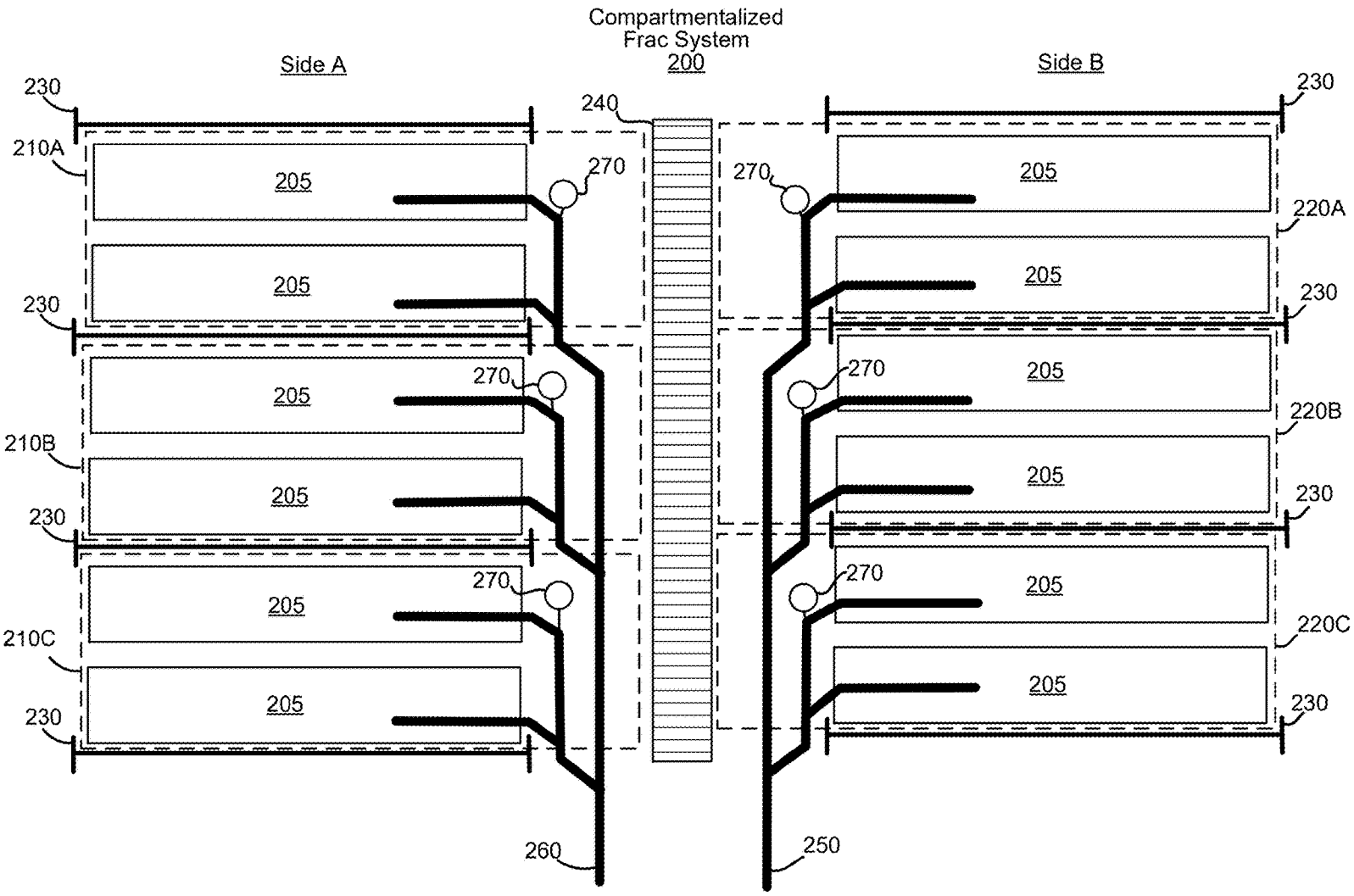
FIGS. 2A-2D are diagrams illustrating different views or components of a compartmentalized frac system, in accordance with one or more embodiments.
Figure 2B:
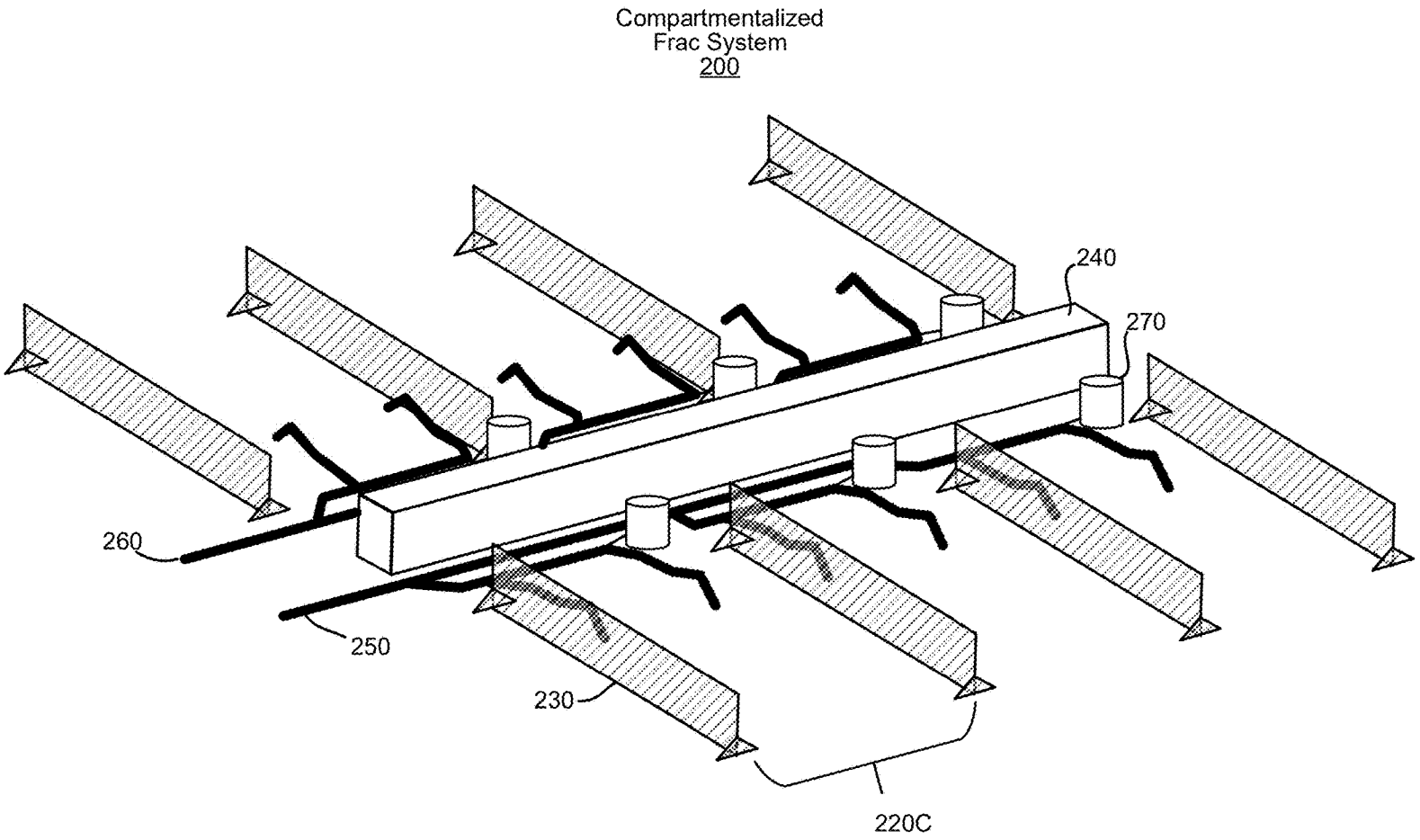
Figure 2C:
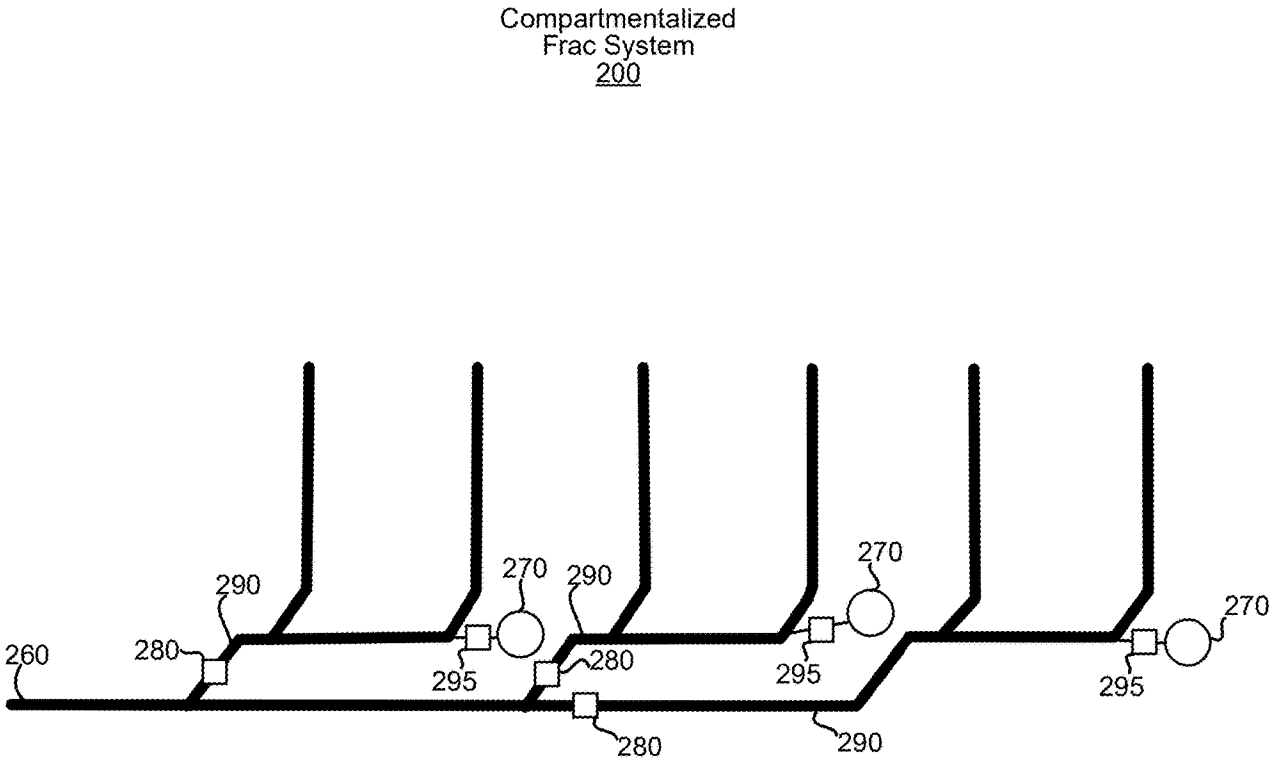
Figure 2D:
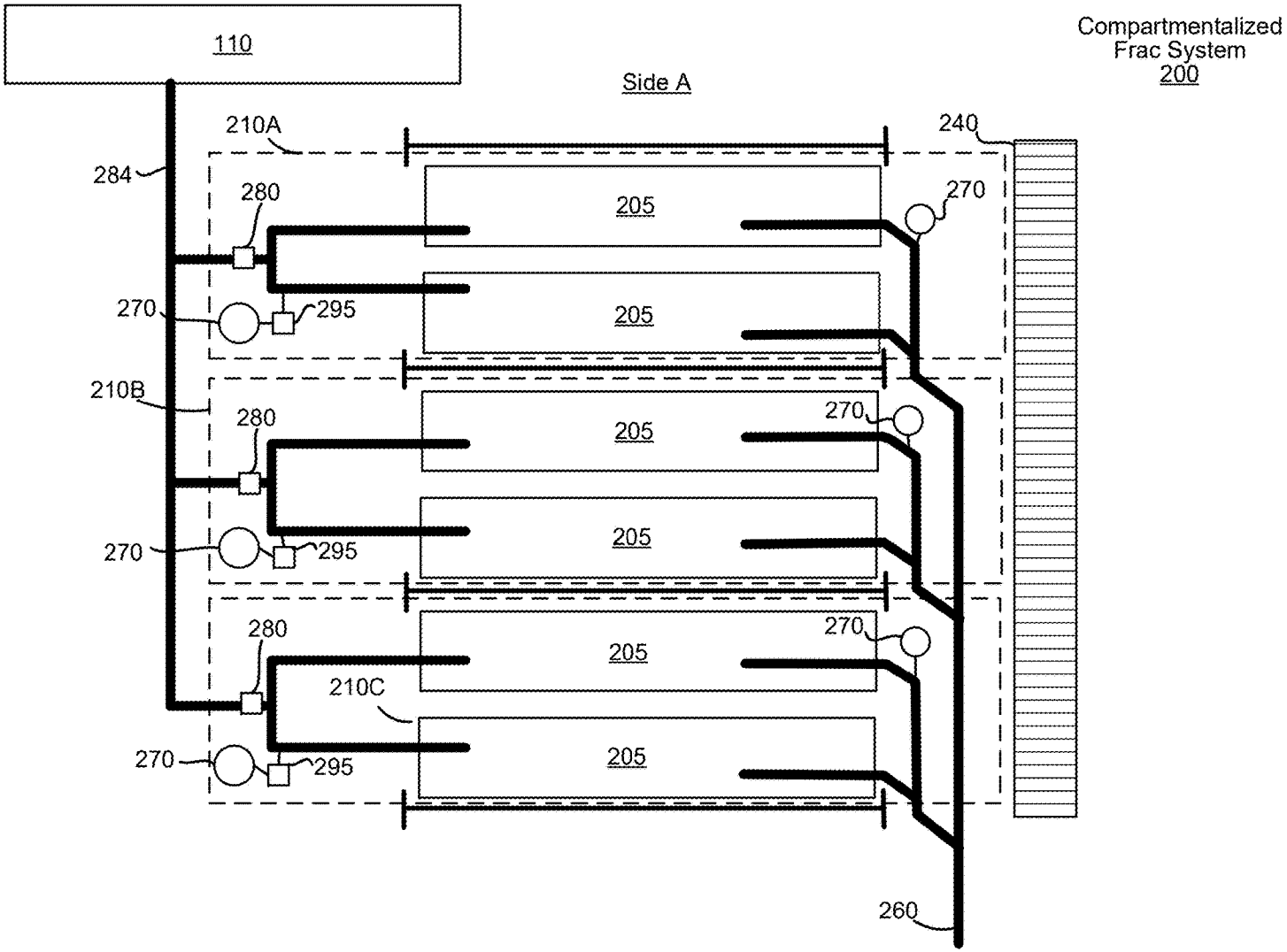

FIGS. 2A-2D ("FIG. 2" collectively) are diagrams illustrating different views or components of a compartmentalized frac system 200, according to one or more embodiments. FIG. 2A is a diagram illustrating an overhead plan view of the compartmentalized frac system 200. FIG. 2B is a diagram illustrating a perspective view of the compartmentalized frac system 200. Note that the frac pumps 205 are omitted from FIG. 2B for simplicity. FIG. 2C is a diagram illustrating a view of mono line 260 isolated from other components of the compartmentalized frac system 200. FIG. 2C also illustrates isolation valves 280, bleed valves 295 (also referred to as prime valves), and labels for segments of mono line 260, which are omitted from FIGS. 2A, 2B and 2C for simplicity. FIG. 2D is a diagram illustrating side A of the compartmentalized frac system 200 of FIG. 2A. FIG. 2D also includes a low-pressure line 284 for zones 210A-210C (low pressure lines are omitted from the FIGS. 2A-2C for simplicity). FIGS. 2A-2D are described together in the descriptions below. Note that reference labels as used herein may refer to a single component or to multiple components. For example, "205" can refer to a single frac pump (e.g., "frac pump 205") or multiple frac pumps (e.g., "frac pumps 205"). As another example, "205" can refer to a frac pump trailer that may include a single electric motor (or prime mover) that powers two frac pumps, one on either side of the electric motor. Any component on the frac pump trailer may require maintenance due to failure or service and the corresponding zone may be taken offline for the maintenance.

The compartmentalized frac system 200 includes a plurality of frac pumps 205 (these may be pumps of fracturing pump transports 108). The embodiment shown in FIG. 2 illustrates a simul-frac configuration where the compartmentalized frac system 200 is fracking two wells simultaneously, one with the mono line 260 and the other with the mono line 250, however a compartmentalized frac system can include any number of wells (one, three, four, etc.). The compartmentalized frac system 200 includes six zones 210A, 210B, 210C, 220A, 220B, and 220C, three on each side of partition wall 240. In this example, each zone includes two frac pumps 205 or two frac pump trailers (among other components as described later), however a zone can include one, three, or more frac pumps 205 or frac pump trailers. Frac pumps in zones 210A-C provide frac fluid into mono line 260, and frac pumps in zones 220A-C provide frac fluid into mono line 250. Each zone is separated from other zones by partition walls 230 and partition wall 240. Partition wall 240 is placed between the mono line 250 and mono line 260. This separates zones on the left side (Side A) from zones on the right side (Side B). Partition walls 230 separate zones on one side from other zones on the same side (e.g., a partition wall 230 separates zone 220A from zone 220B).

As previously stated, partition walls are positioned between zones 210A-C, 220A-C. A partition wall 230, 240 is a structure configured to prevent or reduce operations occurring in one zone from affecting operations in another (e.g., adjacent) zone. For example, a partition wall 230, 240 prevents or reduces a failure event in one zone from affecting operations in an adjacent zone (e.g., normal operations or service operations). In another example, if a first zone is deactivated, partition walls 230, 240 help allow service personnel to operate in the first zone (e.g., safely and/or without concern of a failure event in an adjacent zone) while an adjacent zone remains activated.

A partition wall 230, 240 may be one or more barriers, one or more walls, one or more containers, or any combination thereof (a partition wall may also referred to as a blast control barrier). For example, a partition wall 230, 240 is a transparent or translucent wall that has adequate blast resistance to meet predetermined safety criteria. As another example, a partition wall 230, 240 is a steel wall having appropriate dimensions and properties to meet the safety criteria. A partition wall may be a protective structure designed to mitigate the effects of explosions, pressure waves, and flying debris in high-risk environments such as industrial sites, oil and gas facilities, and military zones. These barriers can be constructed using reinforced materials like steel, composite panels, or energy-absorbing Kevlar fabric layers to withstand extreme forces. Their primary function is to shield personnel, equipment, and infrastructure by redirecting blast energy, reducing overpressure, and containing fragmentation. In some embodiments, the cross-section of a barrier includes a triangular (or "teepee") shape. The inclined angled side walls may help redirect projectiles or blast energy. Depending on the application, blast control barriers may be fixed or modular, allowing for flexible deployment and configuration to suit specific site requirements. For a compartmentalized frac system, modular blast control shields may be used that can be configured to isolate zones and protect personnel from the adjacent zones that are active. In hydraulic fracturing operations, blast control barriers help in missile and hose whip hazard protection by containing debris from high-pressure failures. When frac iron, frac hoses, or other pressurized components rupture or disconnect, they can release extreme force, sending heavy metal fragments and high-velocity projectiles across the site. Blast control barriers are strategically positioned to absorb impact energy and prevent these hazardous projectiles from reaching personnel and critical equipment. These barriers are engineered with reinforced structural elements, such as steel frames and/or ballistic-rated panels, to withstand the immense forces generated by high-pressure system failures, ensuring enhanced safety in frac site operations. These barriers may be strategically positioned so that personnel working on a piece of equipment in a deactivated zone have no direct line of sight (also "line of fire") to a pressurized piece of equipment in an adjacent active zone that is within a threshold distance (e.g., 35 feet). In some embodiments, a barrier height is taller than a human (e.g., 142 and ⅛ inches tall).

A mono line 250, 260 is a line that is used to transport frac fluid to a wellhead and into the wellbore. Frac pumps 205 of each zone can pump frac fluid into the corresponding segment of the mono line. A mono line includes segments 290 (labeled in FIG. 2C) coupled to the frac pumps or pump trailers of each zone (e.g., a different segment for each zone). An isolation valve 280 (e.g., a gate valve or plug valve) may couple a segment 290 to the rest of the mono line (e.g., 260). An isolation valve 280 is configured to control the flow of fluid between (a) one or more frac pumps 205 of a given zone and (b) the rest of the mono line (e.g., 260). Thus, an isolation valve 280 can isolate a segment 290 (and thus a zone (e.g., 210C)) from the rest of the mono line. An isolation valve 280 or a bleed valve 295 can be remotely controlled (e.g., via an actuator) by a control system. In some embodiments, each zone may include more than one isolation valve (e.g., one valve for each frac pump trailer of the zone, one valve for each frac pump of each frac pump trailer, and the like). In some embodiments, double isolation valves are used on high pressure lines (to isolate the zone) and/or on low pressure lines.

Each zone includes the segments 290 and the isolation valves (e.g., gate valves, plug valves) 280 to isolate the high-pressure mono line 250, 260 from the zone, and bleed off the high-pressure from the pumps in that zone into the bleed tank 270 via the bleed valve 295. As illustrated in FIG. 2D, each zone may further include one or more isolation valves (e.g., gate valves, plug valves) 280 at the low-pressure end (e.g., upstream end of the frac pump trailer or the frac pump in the zone) to isolate a zone from a low-pressure line 284 that feeds frac fluid into the one or more frac pumps or pump trailers of the zone. An isolation valve of a high-pressure line may be referred to as a "high-pressure" isolation valve, and an isolation valve of a low-pressure line may be referred to as a "low-pressure" isolation valve.

FIG. 2C shows that a segment 290 of a high-pressure line 260 may be coupled to a bleed tank 270 (e.g., mounted to a skid) via a bleed valve 295. Similarly, FIG. 2D shows that a segment of a low-pressure line 284 may be coupled to a bleed tank 270 via a bleed valve 295, however, in some embodiments, the low-pressure side of a zone (e.g., 210A) does not include a bleed tank 270 or a bleed valve 295. A bleed tank 270 is a container designed to depressurize and store frac fluid from a high-pressure line and/or a low-pressure line (e.g., during maintenance or failure operations). Example bleed valves include gate valves, poppet valves, or plug valves. A bleed valve 295 is configured to control the flow of fluid between the bleed tank 270 and fluid in a segment of the zone (e.g., a bleed valve 295 can release pressurized frac fluid into the bleed tank 270). Thus, one or more bleed tanks 270 and bleed valves 295 can be used to depressurize a zone (e.g., after the corresponding isolation valves 280 are closed and/or after the frac pumps are turned off). Note that an isolation valve or a bleed valve may be a double valve. In the example of FIG. 2, each zone (e.g., 210A) includes a bleed tank 270 and bleed valve 295 for the low-pressure side and a separate bleed tank 270 and bleed valve 295 for the high-pressure side. However, this is not required. For example, a bleed tank 270 may be coupled to lines of two or more (e.g., adjacent) zones. In another example, a zone may include a single bleed tank 270 coupled to both the high- and low-pressure sides. A bleed tank or bleed valve of a high-pressure line may be referred to as a "high-pressure" bleed tank or valve, and a bleed tank or bleed valve of a low-pressure line may be referred to as a "low-pressure" bleed tank or valve.

As illustrated in FIG. 2D, each zone may include an isolation valve 280 at the low-pressure line 284 (for example, isolation valves to isolate low pressure fluid supply from the blender to the frac pumps and an isolation valve for each frac pump). Closing this valve 280 for a zone will allow low pressure frac fluid to be supplied to other zones, while stopping frac fluid from flowing into the zone. The low-pressure side may also include a bleed valve 295 to open the low-pressure side of the line to atmosphere and bleed off any fluid in the line to a bleed tank.

More generally, each zone of a compartmentalized frac system (e.g., 200) can include one or more bleed tanks 270 to bleed off (also "depressurize") high-pressure and low-pressure lines of that zone (e.g., after the zone is isolated by actuating remotely the isolation valves for the high-pressure and low-pressure lines). By bleeding off the high-pressure and low-pressure lines via bleed tanks and bleed valves, and keeping the bleed valves open to atmosphere, a zone can be deactivated, thereby making it temporarily available (e.g., safe) for personnel to enter and perform the service operations on equipment in the deactivated zone. Deactivating a zone may also include disconnecting power to (e.g., turning off) one or more components in a zone (e.g., disconnecting power to a frac pump), as further described below.

In some embodiments, a zone (e.g., each zone) of a compartmentalized frac system 200 includes a pressure release valve (e.g., in parallel to a bleed valve 295) configured to release fluid (e.g., into the bleed tank 270) if pressure in the line exceeds a threshold pressure. A pressure release valve may be referred to as a relief valve.

Figure 7A:
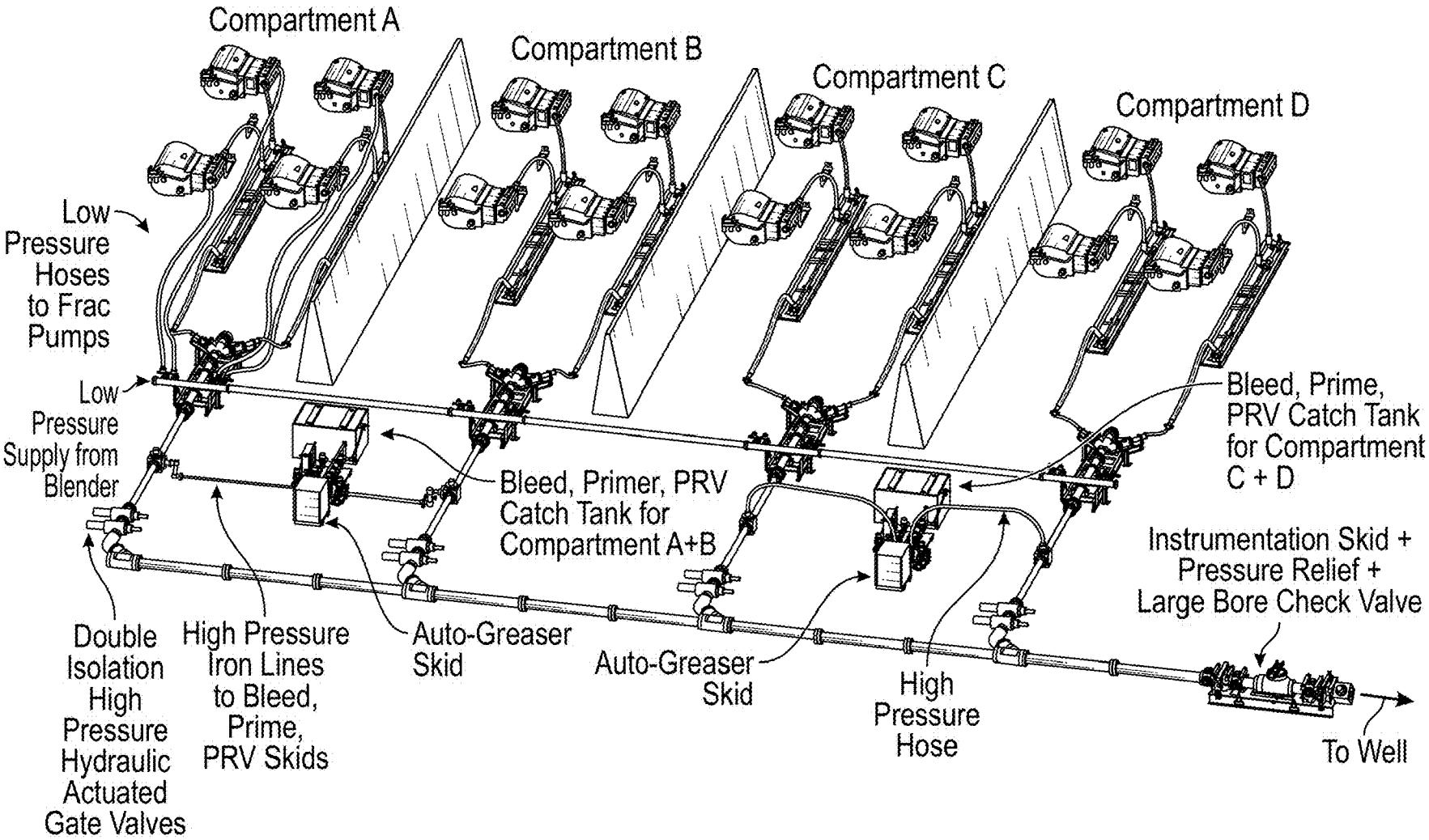
FIGS. 7A-7F are diagrams of another compartmentalized frac system, according to one or more embodiments.
Figure 7B:
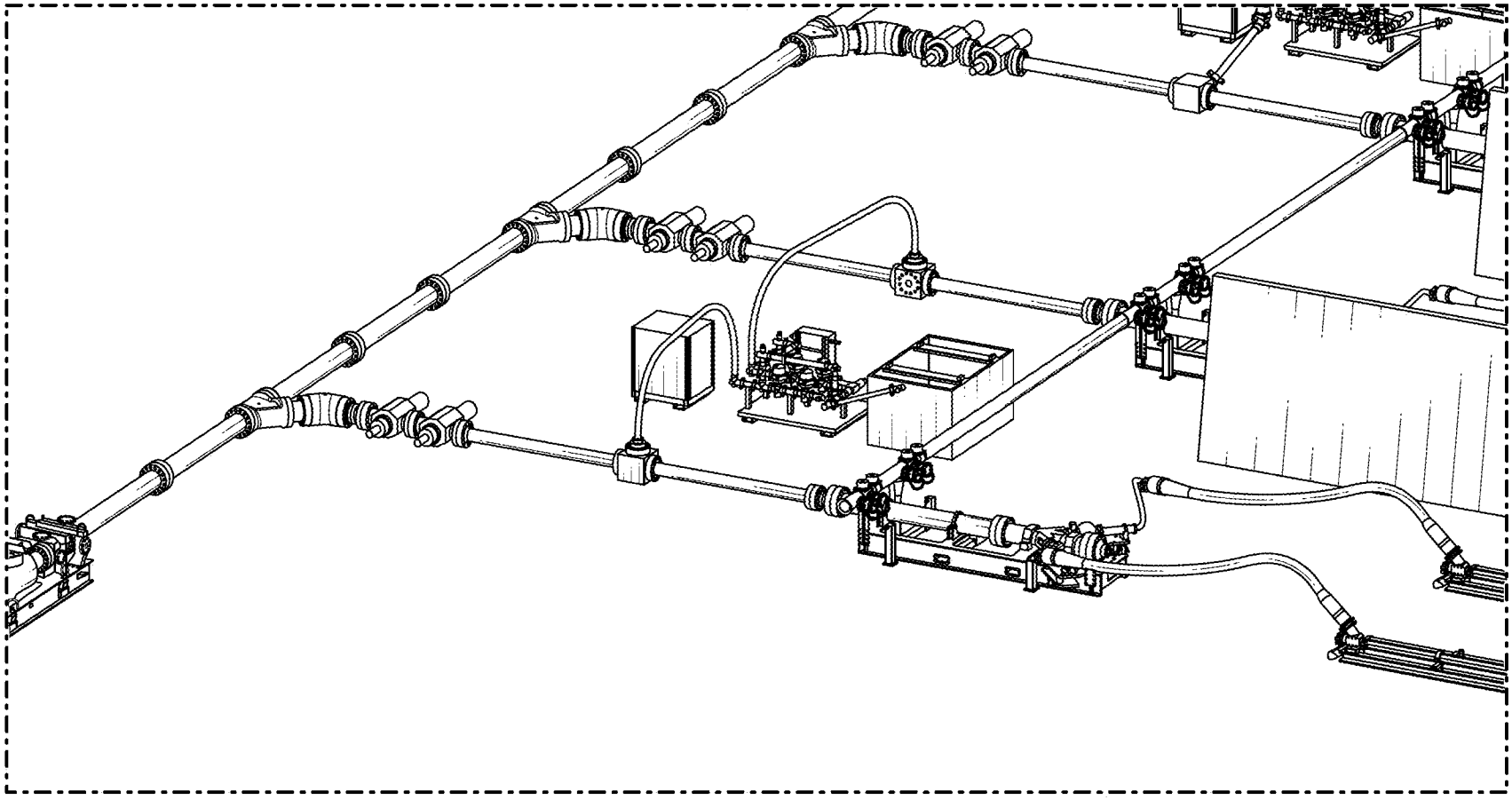

In some embodiments, a zone (e.g., each zone) of a compartmentalized frac system 200 includes a greaser skid configured to deliver grease to relevant components (e.g., valves), thus reducing or eliminating manual greasing by humans and reducing maintenance time and personnel exposure to hazardous areas. Example greaser skids are illustrated in FIGS. 7A and 7B.

As previously described, a frac system (e.g., 200) may include a switch gear trailer (e.g., 112) that provides power to the frac pumps 205 to power electric motors that drive the frac pumps (the switch gear trailer is not illustrated in FIG. 2). In one or more embodiments, the switch gear trailer may receive power at a relatively high-voltage level (e.g., 13.8 kilovolts) from a power generation trailer (e.g., 102) e.g., that includes a gas turbine and a generator for generating mobile electric power. The switch gear trailer may transmit the high-voltage level (e.g., 13.8 kilovolts) without performing a voltage step-down operation to downstream trailers such as the frac pumps 205, blender trailers (e.g., 110), and the like. The switch gear trailer may be connected to each frac pump or each frac pump trailer using a single cable connection. Each frac pump trailer may include one or more transformers to step down the voltage received from the switch gear trailer 112 to one or more lower voltage levels (e.g., 4.2 kilovolts, 600 volts, and the like) to provide power to different equipment (e.g., the electric motor, variable frequency drives, sensors, actuators, other equipment) of the frac pump trailer. To deenergize a zone (e.g., during deactivation), an entity (e.g., service personnel or a control system) may remotely turn off the power supply from the switch gear trailer (e.g., 112) to the one or more frac pumps of that particular zone. For example, the power may be turned off by manually operating levers provided on the switch gear trailer. As another example, the power may be turned off by remotely shutting off power supply from the data van or other location remote to the well site.

After completion of the desired service (e.g., maintenance or failure operations), a zone can be brought back online so the zone can resume contributing frac fluid to the corresponding mono line. Examples steps for reactivating a zone include priming the high-pressure and low-pressure lines, equalizing the pressure with the corresponding mono line (e.g., 250 or 260), and opening the isolation valve for that zone to restart sending fluid downhole from the selected zone.

As previously stated, a frac system (e.g., 200) may include a control system (e.g., implemented in whole or in part via data van 114). The control system may (e.g., remotely) control deactivation and reactivation of a zone in a compartmentalized frac system (e.g., 200). The control system may manage the flow rate or pressure that is being pumped downhole while one or more zones are selectively taken offline and brought back online. For example, the control system may automatically ramp up flow rates or pressures from other zones when a particular zone is deactivated and then ramp down the flow rates or pressures from the other zones as the particular zone is brought back online, so as to maintain target flow rates or pressures (e.g., per contractual agreements).

The control system may be configured to utilize sensors and actuators to automate the zone deactivation or reactivation processes. For example, based on a user instruction or a predetermined service condition being satisfied (e.g., a maintenance schedule indicates service should be performed on a zone, a detected failure condition (e.g., determined based on sensor data or a user indication) is determined in a zone), the control system automatically actuates components to deactivate a zone. This may include shutting off power to the zone, isolating the zone from the high-pressure mono line, isolating the zone from the low-pressure mono line, bleeding off the high-pressure and the low-pressure fluids in the zone to a bleed tank, and keeping the high-pressure and the low-pressure lines of the zone open to atmosphere. The control system may utilize sensors to detect when the zone is deactivated (e.g., and thus safe for personnel to enter) and issue a notification (e.g., via a user interface) indicating the same.

The control system may take steps to automatically reactivate the zone (e.g., after the service work is completed and the zone is ready for reactivation). The control system may reactivate a zone after receiving a reactivation instruction (e.g., from a user) or based on sensor data indicating that a service condition (e.g., a failure condition) has been resolved. To reactivate a zone, the control system may restart the power supply from the switch gear to the one or more frac pumps included in the zone and operates the electric motors to begin driving the frac pumps in the zone to prime the high-pressure or low-pressure fluid lines in the zone. To prime a line of a zone (e.g., to prime a segment of a mono line), the low-pressure bleed valve is closed (if the zone includes a low-pressure bleed valve) and the low-pressure isolation valve is opened to let the frac fluid into the zone, and the one or more frac pumps of that zone may be operated while keeping the high-pressure bleed valve open so that air in the line is removed (while the high-pressure isolation valve remains closed). This priming operation may be performed until the control system determines the line is primed. For example, the line is primed for a threshold amount of time (e.g., for approximately one minute while the pump(s) move fluid at a threshold rate (e.g., five bbl/min)), a user confirmation is received, the control system determines air in the line is below a target threshold (e.g., based on sensor data), or some combination thereof.

After the line is primed, the control system closes the bleed valve(s) (e.g., the high-pressure bleed valve). The control system may then continue to operate the frac pumps while the high-pressure isolation valve remains closed to increase the pressure in the high-pressure line to equalize the pressure with that in the mono line 250, 260 (e.g., six thousand pounds per square inch). The control system may determine pressure equalization has occurred based on data generated by one or more pressure sensors. The control system may then open the isolation valve (e.g., by controlling an actuator) and begin sending fluid downhole from the zone.

After the line is primed, the (e.g., high-pressure) bleed valve is closed, and the isolation valve remains closed, in some embodiments the control system performs a pressure test by operating the pumps to increase the pressure in the line to be above the pressure in the mono line 250, 260 (the pressure in the mono line may be referred to as the "equalization pressure"). The pressure in the line may be increased to a target pressure (e.g., nine thousand pounds per square inch) that is significantly higher than the pressure in the mono line (e.g., 10% or 1,500 PSI above the pressure in the mono line) but below a threshold pressure of a pressure release valve of the high-pressure mono line. For example, if service was performed on the zone, increasing the pressure to the target pressure helps confirm that the zone was serviced properly and components in the zone are functioning as intended (e.g., they were installed or repaired correctly). The pressure test may also help identify any potential leaks in the line. After the target high pressure is reached (e.g., and the zone is confirmed to be operating as desired), the control system may control the zone to equalize the pressure in the line with the pressure in the mono line. In one example, the control system (e.g., slowly) reduces the pressure in the line until the pressure lowers to the equalization pressure (e.g., by actively controlling the bleed valve and the frac pumps). In another example, the control system opens the (e.g., high-pressure) bleed valve to release the pressure in the line. The control system may then close the (e.g., high-pressure) bleed valve and operate the pumps to bring the pressure up to the equalization pressure.

The following paragraphs describe setting up a compartmentalized frac system and steps a control system may take to deactivate and later reactivate a zone of a compartmentalized frac system. Among other advantages, deactivating a zone may temporarily create a safe zone without having to move equipment around or out of the red zone.

To set up a compartmentalized frac system, an operator may determine the number of zones and the number of frac pumps to be included in each zone based on, for example, customer requirements for downhole pressure and rate, site layout, equipment availability, and equipment specifications. The compartmentalized frac system, including the isolation valves, the bleed and prime skids, the partition walls, power supply connections, and the like (e.g., the relief system), may be set up based on the determined design.

During fracking, when a service event is detected (e.g., a scheduled or unexpected maintenance or failure event), the control system may detect which zone is affected and take steps to deactivate the zone while also ramping up the production from the other zones to compensate for the loss of rate (or pressure) from the zone being deactivated.

Firstly, the control system may ramp down the frac pumps of the zone (e.g., to zero RPM (revolutions per minute). For example, the frac pumps are instructed to stop stroking. In some embodiments, the control system turns off the power to the frac pumps in the identified zone. For example, the control system may operate an actuator that remotely switches off the power supply from the switch gear trailer to the one or more frac pumps in the affected zone. Disconnecting the power from frac pumps may decrease the likelihood of the frac pumps (e.g., unintentionally) operating during service work. Other components in a zone may be deenergized as well (e.g., turned off or disconnected from a power source) during the deactivation process.

The control system may isolate the high-pressure fluid flowing into the mono line from the affected zone by closing a first isolation valve for that zone (this valve may be referred to as a "high-pressure isolation valve"). The control system may also isolate the low-pressure frac fluid from flowing into the pumps in the affected zone by closing a second isolation valve (or multiple redundant isolation valves) for that zone (this valve may be referred to as a "low-pressure isolation valve"). For example, the isolation valves are plug valves, butterfly valves, or gate valves and they are actuated remotely to isolate the high-pressure and low-pressure lines for the affected zone. In some embodiments, any isolation valve of a zone may be interlocked with the frac pumps of that zone such that the valves cannot be closed until the pumps are safely ramped down (e.g., to zero RPM).

Next, the control system may open a high-pressure bleed valve of the affected zone to bleed off the high-pressure fluid downstream of the frac pumps to one or more bleed tanks. The high pressure frac fluid may bleed off through a remotely controlled, adjustable or fixed choke. The choke may have carbide seat or hardened steel interior components for wear resistance. The control system may also open a low-pressure bleed valve of the affected zone to bleed off the low-pressure fluid upstream of the frac pumps in the zone into the one or more bleed tanks. The control system may utilize a sensor (e.g., a flow rate sensor or pressure sensor) to confirm the affected zone is deactivated after the high-pressure and low-pressure lines of the affected zone have been bled off. The control system may also utilize sensors to confirm the high-pressure and low-pressure lines in the zone are open to atmosphere.

Based on a determination that the zone is deactivated, the control system may provide a notification to an operator (e.g., via a user interface) that the zone is deactivated (e.g., this may further state that the zone is safe for human entry). After completion of the service work, an operator may notify the control system that the zone is now ready to be reactivated.

Subsequent (e.g., responsive) to the notification, the control system may restart power to the zone (e.g., by connecting the frac pumps to the switch gear trailer) and/or increasing the RPM of the frac pumps in the zone. The control system may prime the high-pressure and low-pressure lines while keeping the bleed valves open. Frac fluid may be introduced to the frac pumps in the zone from the blender trailer by opening the isolation valve for the low-pressure lines to prime the frac pumps and the high-pressure lines. After detecting the lines have been sufficiently primed (e.g., based on sensor data), the control system closes the bleed valves. The control system may ramp up the pressure on the high-pressure lines until the pressure has equalized with the high-pressure on the mono line feeding the frac fluid downhole. After equalizing the pressure, the control system may actuate the isolation valve on the high-pressure line to begin sending fluid downhole. As previously described, the control system may, additionally or alternatively, perform a pressure test prior to opening the high-pressure isolation valves.

Thus, a compartmentalized frac system 200 may enable a zone to be deactivated without disconnecting electrical connections, without disconnecting high-pressure or low-pressure fluid connections, without moving pump trailers out of their designated spot during operation, or any combination thereof. As a result, service operation time can be reduced, and the zone can be reactivated relatively quickly after completion of the service work.

Although some of the descriptions herein refer to the control system performing operations automatically, this is not required. Any combination of operations performed by a control system described herein may be performed subsequent (e.g., responsive) to receiving a user instruction, semi-automatically (e.g., the control system begins performing a first operation automatically but waits for a user instruction (e.g., confirmation) before (a) completing the first operation or (b) performing a second subsequent operation), fully automatically, or some combination thereof. In some embodiments, the type of service event for a zone affects the level of automation by the control system. For example, if the service event is a routine and scheduled event for a zone, the control system may wait for a user instruction before performing one or more operations of a deactivation process for that zone. However, if the control system detects (based on sensor data) an event in a zone that requires quick or immediate service (e.g., a sudden loss in pressure signaling a leak in a line), the control system may automatically perform one or more operations of a deactivation process.

As used herein, a service condition (also "service event") for a zone may refer to a condition (e.g., a circumstance or event) that, after the condition is met, indicates the zone should be deactivated to allow service to be performed on that zone. Example service conditions may include a maintenance schedule, a user indication, or a failure event (e.g., detected by the control system based on sensor data) indicating service should be performed. As used herein, a reactivation condition for a zone may refer to a condition that, after the condition is met, indicates the zone can be reactivated. An example reactivation condition is a user indication indicating service of the zone is complete.

Figure 3:
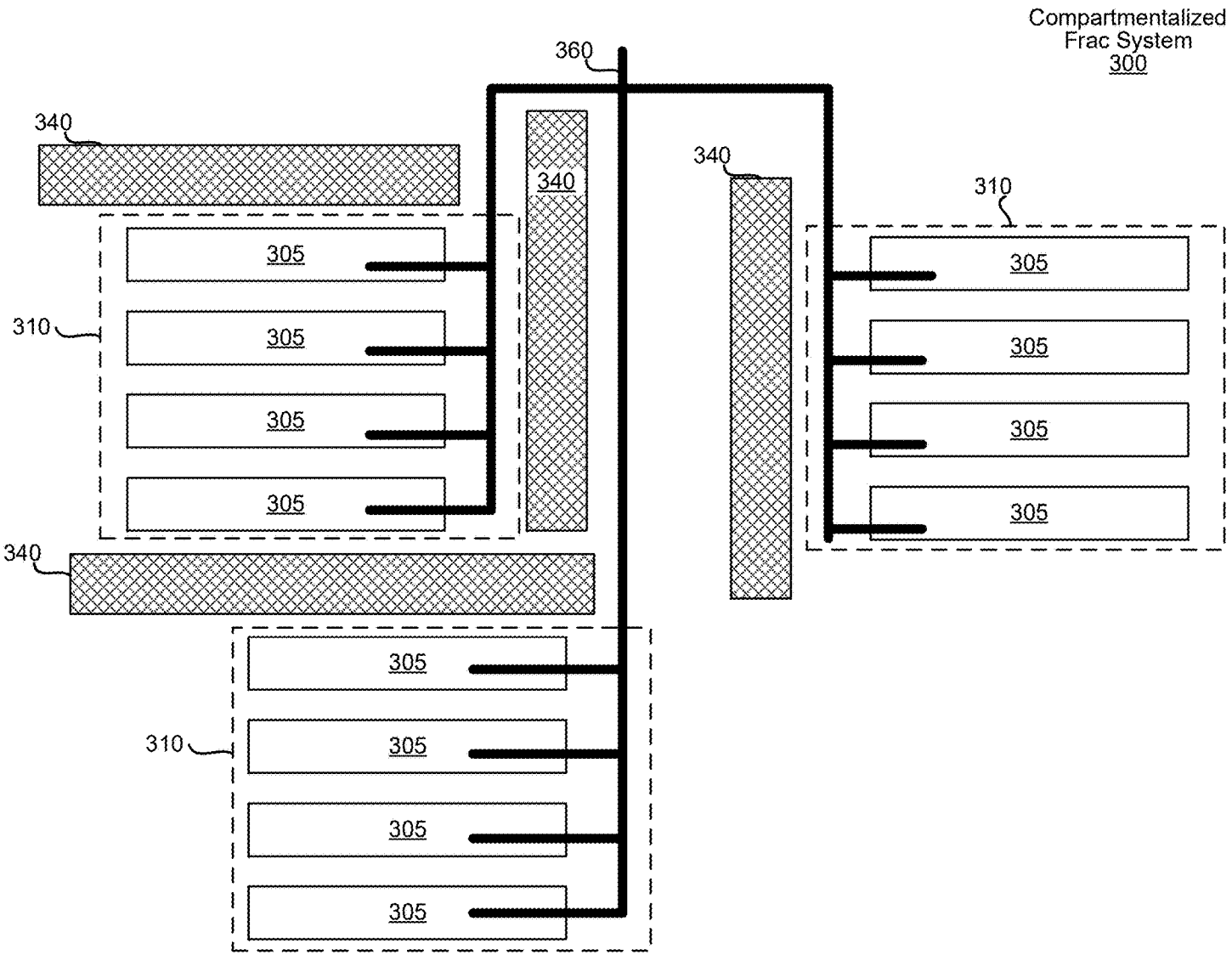
FIG. 3 is a diagram of another compartmentalized frac system that includes three zones, in accordance with one or more embodiments.

FIG. 3 is a diagram of another compartmentalized frac system 300 that includes three zones 310, according to one or more embodiments. Each zone 310 includes four frac pumps trailers 305 (e.g., each trailer 305 may include one or more frac pumps), and all zones 310 connect to a single mono line 360 sending high-pressure frac fluid into a wellbore. Multiple partition walls 340 separate the zones 310. Note that the low-pressure side of FIG. 3 is omitted for simplicity. Although not illustrated, one or more blender transports provide low-pressure frac fluid to each frac pump trailer 305 of each zone 310.

FIGS. 7A-7F ("FIG. 7" collectively) are diagrams of another compartmentalized frac system, according to one or more embodiments. FIG. 7A is a first perspective view of the compartmentalized frac system. FIG. 7B is a second perspective view of the compartmentalized frac system. The compartmentalized frac system includes four zones (referred to as compartments A-D). The compartmentalized frac system includes a low-pressure supply line from a blender (e.g., 110) that carries low-pressure fluid across all four compartments. Via a pump station pod (e.g., see FIG. 7E) and low-pressure hoses, the low-pressure fluid is provided from the low-pressure supply line to individual frac pumps. For ease of illustration, the low-pressure hoses are only illustrated for compartment A. Double isolation high pressure hydraulic actuated gate valves connect the high-pressure line of each compartment to the mono line (which leads to a well). The mono line includes an instrumentation skid, a pressure relieve valve, and a bore check valve. Compartments A and B are both coupled to a bleed skid that includes bleed valves, pressure relieve valves (PRVs), and a bleed tank (note that the bleed tank may be on a separate skid). Compartments A and B are coupled to the bleed skid via high-pressure iron lines. The bleed skid is further described with respect to FIGS. 7C-7D. Compartments A and B are also coupled to an auto-greaser skid. Compartments C and D are similarly coupled to a second bleed skid and a second auto-greaser skid. Compartments C and D are coupled to the second bleed skid via high pressure hoses.

Figure 7C:
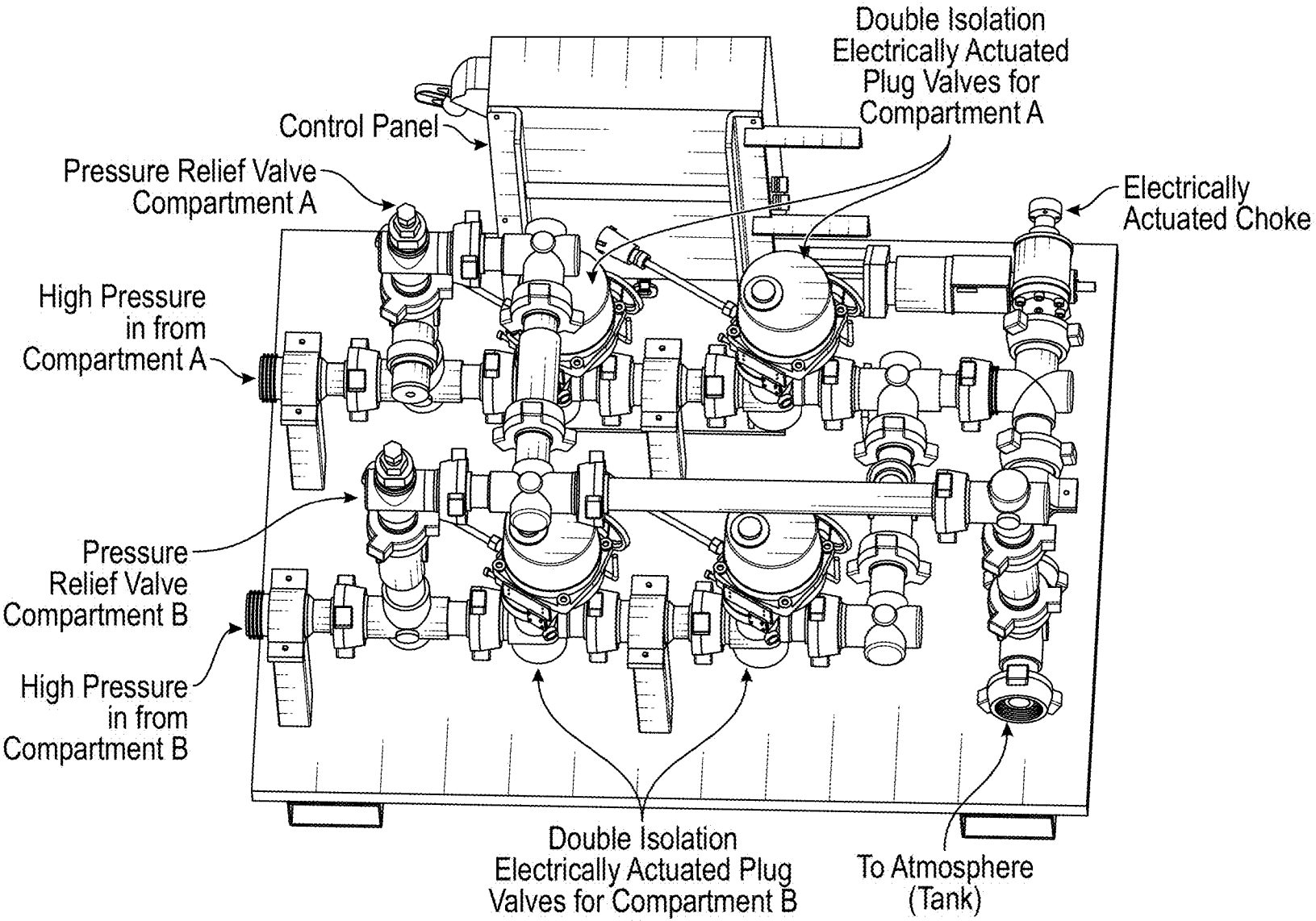
Figure 7D:
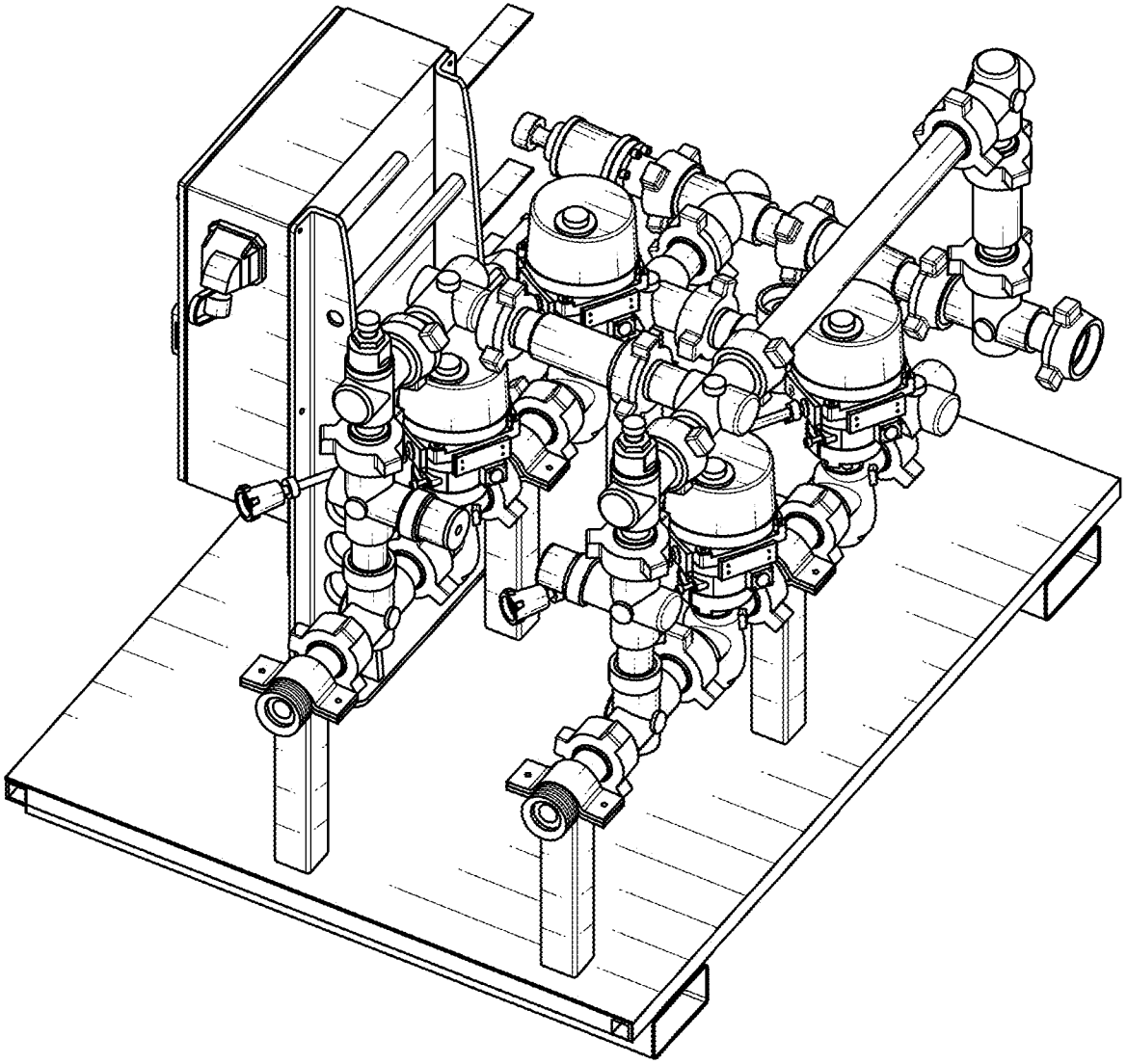

FIG. 7C is a first perspective view of the bleed skid coupled to compartments A and B. FIG. 7D is a second perspective view of the bleed skid. In this example, the bleed skid includes a control panel, a first line that receives high-pressure fluid from compartment A, a second line that receives high-pressure fluid from compartment B, and a third line that can carry fluid to a (bleed) tank that is open to atmosphere (the tank is not illustrated). The first line includes a pressure relieve valve and double isolation electrically actuated plug valves for compartment A (these are bleed valves). The second line includes a pressure relieve valve and double isolation electrically actuated plug valves for compartment B (these are bleed valves). The first and second lines are connected to the third line, and the bleed valves control the flow of fluid in each line to the third line. Output from both relief valves is also directed to the third line. The third line also includes an electrically actuated choke.

Figure 7E:
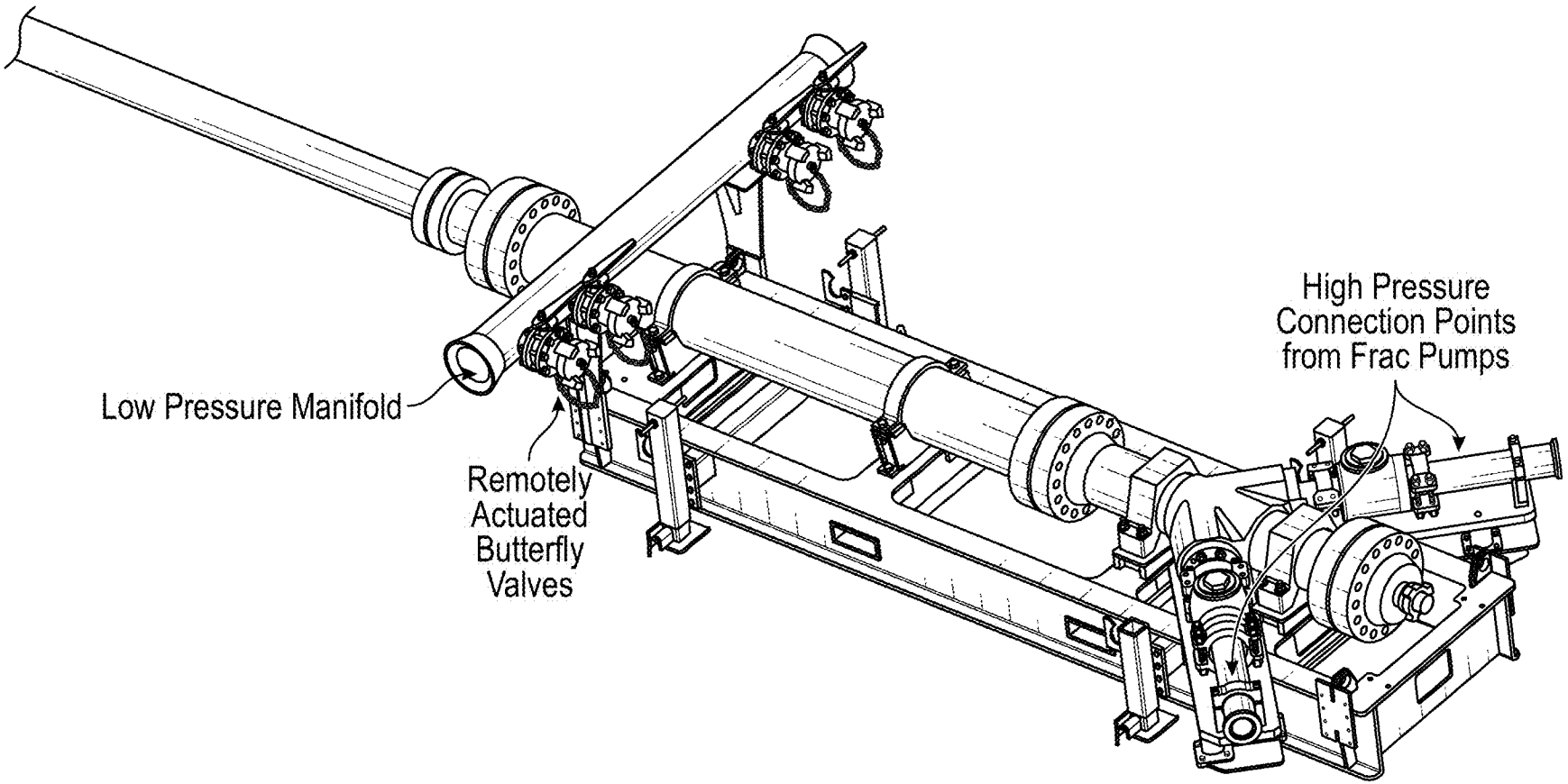
Figure 7F:
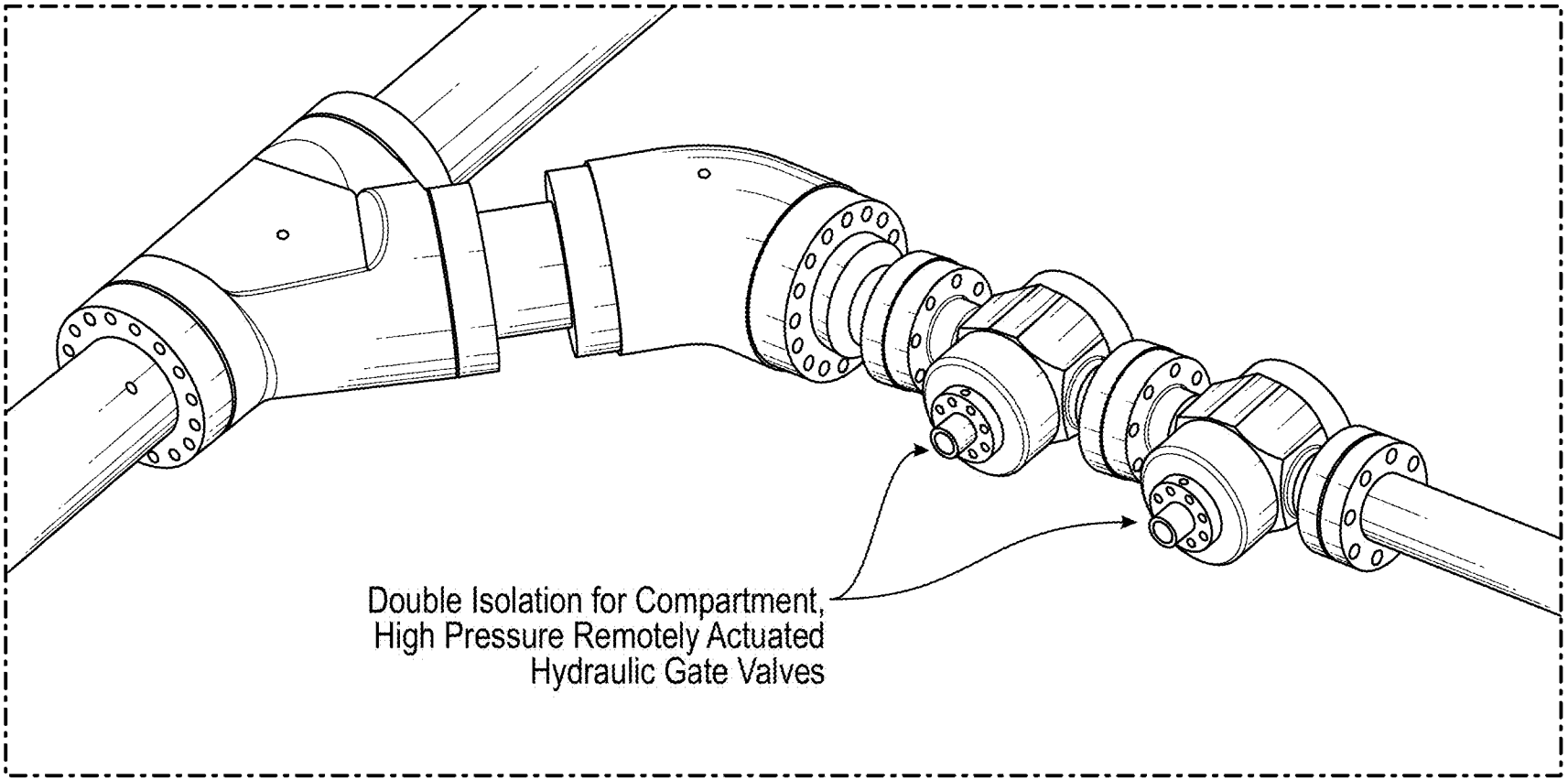

FIG. 7E is a perspective view of a pump station pod. The pump station pod includes high pressure connection points to receive fluid from different frac pumps. The pump station pod also includes a low-pressure manifold (this is part of the low-pressure supply line in FIGS. 7A-7B) and remotely actuated butterfly valves (these connect to the frac pumps via low-pressure hoses). FIG. 7F is a perspective view of a double isolation valve on one of the high-pressure lines of a compartment. In this example, the double isolation valve includes two high-pressure remotely actuated hydraulic gate valves.

Example Control System

Figure 4:
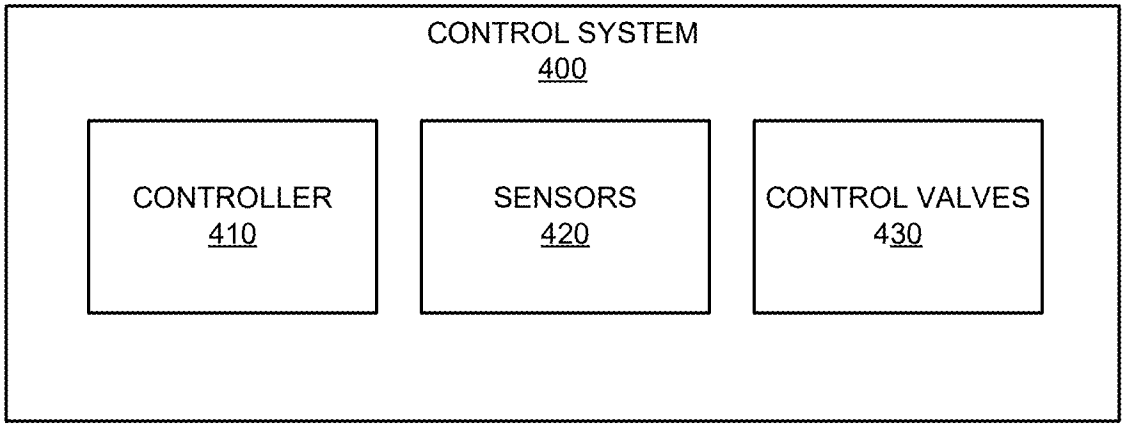
FIG. 4 is a block diagram of a control system of a compartmentalized frac system, in accordance with one or more embodiments.

FIG. 4 is a block diagram of a control system 400 of a compartmentalized frac system, in accordance with one or more embodiments. The control system 400 illustrated in FIG. 4 may be operable with any of the illustrated frac systems (e.g., system 103, 200, 300) according to the present disclosure.

In one or more embodiments, the control system 400 includes a controller 410, sensors 420, and valves 430. The sensors 420 (e.g., flow rate sensors, pressure sensors, temperature sensors, position sensors, vibration sensors (e.g., coupled to frac pumps) and the like) may measure various metrics in a compartmentalized frac system. For example, sensors in a zone may generate data indicative of the pressure or flow rate of frac fluid in the zone. In another example, a position sensor may generate data indicative of the position of a valve, such as whether a valve (e.g., 280 or 295) is in an open or closed position. Each zone of a compartmentalized frac system may include the same or a similar set of one or more sensors 420 that enable the control system 400 to, based on data from the sensors, determine a service condition has occurred, perform deactivation operations for a zone, perform deactivation operations for a zone, determine a condition to confirm a deactivation process for a zone is complete, determine a condition to begin a reactivation process for a zone, perform reactivation operations for a zone, determine a condition to confirm a reactivation process for a zone is complete, or any combination thereof. Components not in a zone may also include sensors that enable the control system 400 to perform the above operations. For example, a mono line (e.g., 260) may include one or more flow rate sensors or pressure sensors.

The controller 410 (e.g., a programmable logic controller) may be configured to control an operation of the compartmentalized frac system (e.g., by determining, generating and/or transmitting control instructions to one or more components of the compartmentalized frac system associated with that operation). For example, the controller 410 can shut off or disconnect power to one or more frac pumps in a zone.

The controller 410 may control an operation based on sensor data generated by one or more of the sensors 420. For example, based on sensor data, the controller 410 controls frac pumps in one or more zones such that the flow rate (or pressure) in the high-pressure mono line is within a target flow rate (or pressure) range (e.g., within 5% or 10% of a target value), for example, even if one or more other zones are being deactivated or reactivated. In another example, based on vibration sensor data from vibration sensors coupled to frac pumps, the controller 410 controls the frac pumps to balance harmonics of the system. In another example, the sensors 420 may generate data indicative of an operation state of frac pumps (e.g., 205) in a zone, and the controller 410 may be configured to change the operational state of the frac pumps (e.g., during a deactivation or reactivation process). In another example, responsive to a sensor indication that an isolation valve for a zone is closed, the controller 410 may be configured to open a bleed valve for that zone to depressurize that zone. In another example, the controller 410 adjusts a pump speed of a frac pump based on sensor data of a vibration sensor coupled to that frac pump.

The control valves 430 may be operable by the controller 410. Example control valves include isolation valves (e.g., 280) and bleed valves (e.g., 295). The controller 410 may automatically operate (e.g., via (e.g., electric or hydraulic) actuators, electric motors) an isolation valve 280 or bleed valve 295 for a zone (or all zones).

Example Compartmentalized Frac System

Some embodiments relate to a frac system (e.g., 200) including: a plurality of frac pump trailers (e.g., 205) for pumping (e.g., high-pressure) frac fluid into a wellbore, wherein the plurality of frac pump trailers are divided into a plurality of zones (e.g., 210A-C and 220A-C), each zone including at least one of the frac pump trailers; a plurality of partition walls (e.g., 230, 240) between the plurality of zones; an (e.g., high-pressure) isolating valve (e.g., 280) in each zone to isolate the flow of the high-pressure frac fluid from the mono line (e.g., 260); a (e.g., high-pressure) bleed and prime skid (e.g., 295 and 270) in each zone to bleed off the high-pressure frac fluid; and a control system (e.g., 400) to control the isolating valve and the bleed and prime skid to remotely deenergize a selected one of the plurality of zones to make it safe for personnel to enter the zone while the other zones adjacent to the selected zone continue to operate; wherein the control system ramps up the flow rate of the other zones as it deenergizes the selected zone to ensure the flow rate being sent downhole remains the same.

Some embodiments relate to a frac system (e.g., 200) including: frac pumps (e.g., 205) each configured to pump (e.g., high pressure) frac fluid into a mono line (e.g., 260), wherein the frac pumps are divided into zones (e.g., 210A-C and 220A-C), each zone including a set of one or more of the frac pumps; partition walls (e.g., 230, 240) between the zones; (e.g., high-pressure) isolation valves (e.g., 280) for the zones, each isolation valve of a zone configured to control the flow of frac fluid between the set of frac pumps and the mono line; (e.g., high-pressure) bleed valves (e.g., 295) for the zones, each bleed valve of a zone configured to release pressurized frac fluid in a zone to a (e.g., high-pressure) bleed tank (e.g., 270); and a control system (e.g., 400) configured to deactivate or reactivate each zone of the compartmentalized frac system by controlling the frac pumps, the isolation valves, and the bleed valves of each zone.

Some embodiments relate to a compartmentalized hydraulic fracturing (frac) system (e.g. 200) including: a mono line (e.g., 260) configured to carry (e.g., high pressure) frac fluid into a well; a plurality of zones (e.g., 210A-C and 220A-C), each zone including: a set of one or more frac pumps (e.g., 205) each configured to pump frac fluid into the mono line; an (e.g., high-pressure) isolation valve (e.g., 280) configured to control the flow of frac fluid between the set of frac pumps and the mono line; and a (e.g., high-pressure) bleed valve (e.g., 295) configured to release pressurized frac fluid from the set of frac pumps when in an open position; partition walls (e.g., 230) between the plurality of zones; and a control system (e.g., 400) configured to deactivate or reactivate a zone of the plurality of zones by controlling the set of frac pumps, the isolation valve, and the bleed valve of the zone.

In some aspects, components in each zone are not shared with other zones. For example, each zone includes its own set of frac pumps, isolation valve, and bleed valve.

In some aspects, to reactivate a zone of the plurality of zones, the control system is configured to: activate the set of frac pumps; subsequent to completion of a priming condition, closing the bleed valve; control the set of frac pumps to adjust the frac fluid pressure to a target pressure (e.g., an equalization pressure) based on frac fluid pressure in the mono line; and subsequent to (e.g., responsive to) the frac fluid pressure reaching the target pressure, open the isolation valve to connect the zone to the mono line. These reactivation steps may be performed while other zones continue to operate.

In some aspects, to reactivate a zone of the plurality of zones, the control system is further configured to: prior to controlling the set of frac pumps to adjust the frac fluid pressure to the target pressure, control the set of frac pumps to increase the frac fluid pressure to a second target pressure based on a service condition for the zone (e.g., a pressure test), wherein the second target pressure is higher than the target pressure.

In some aspects, the control system is further configured to: ramp down other zones in conjunction with opening the isolation valve (e.g., such that the flow rate and/or pressure in the mono line remains constant (e.g., within a threshold variation range)).

In some aspects, to deactivate a zone of the plurality of zones, the control system is configured to: deactivate the set of frac pumps; close the isolation valve to isolate the zone from the mono line; and open the bleed valve.

In some aspects, to deactivate a zone of the plurality of zones, the control system is further configured to: ramp up other zones in conjunction with closing the isolation valve (e.g., such that the flow rate and/or pressure in the mono line remains constant (e.g., within a threshold variation range)).

In some aspects, the control system is configured to remotely deactivate or reactivate the zone based on sensor data from a sensor coupled to a component of the zone.

In some aspects, the control system is further configured to: receive sensor data generated by a sensor coupled to a component a zone of the plurality of zones; analyze the sensor data; determine, based on the sensor data analysis, a service condition is met; and automatically begin deactivation of the zone.

In some aspects, the control system is further configured to individually deactivate or reactivate any zone of the plurality of zones.

In some aspects, the control system is configured to begin a deactivation of a zone of the plurality of zones responsive to receiving a user instruction to deactivate the zone.

In some aspects, each zone further includes: a second (e.g., low-pressure) line (e.g., 284) configured to carry frac fluid from a blender transport (e.g., 110) to the set of one or more frac pumps; a second (e.g., low-pressure) isolation valve (e.g., 280) at the second line and configured to control the flow of frac fluid between the blender transport and the set of frac pumps; and a second (e.g., low-pressure) bleed valve (e.g., 295) configured to release pressurized frac fluid in a segment of the second line between the second isolation valve and the set of one or more frac pumps when in an open position.

In some aspects, to reactivate a zone of the plurality of zones, the control system is configured to: close the second bleed valve; open the second isolation valve; activate the set of frac pumps; subsequent to completion of a priming condition, closing the bleed valve; control the set of frac pumps to adjust the frac fluid pressure to a target pressure based on frac fluid pressure in the mono line; and subsequent to the frac fluid pressure reaching the target pressure, open the isolation valve to connect the zone to the mono line.

Other aspects include components, devices, systems, improvements, methods, processes, applications, computer readable mediums, and other technologies related to any of the above.

Example Method of Operating a Compartmentalized Frac System

Figure 5:
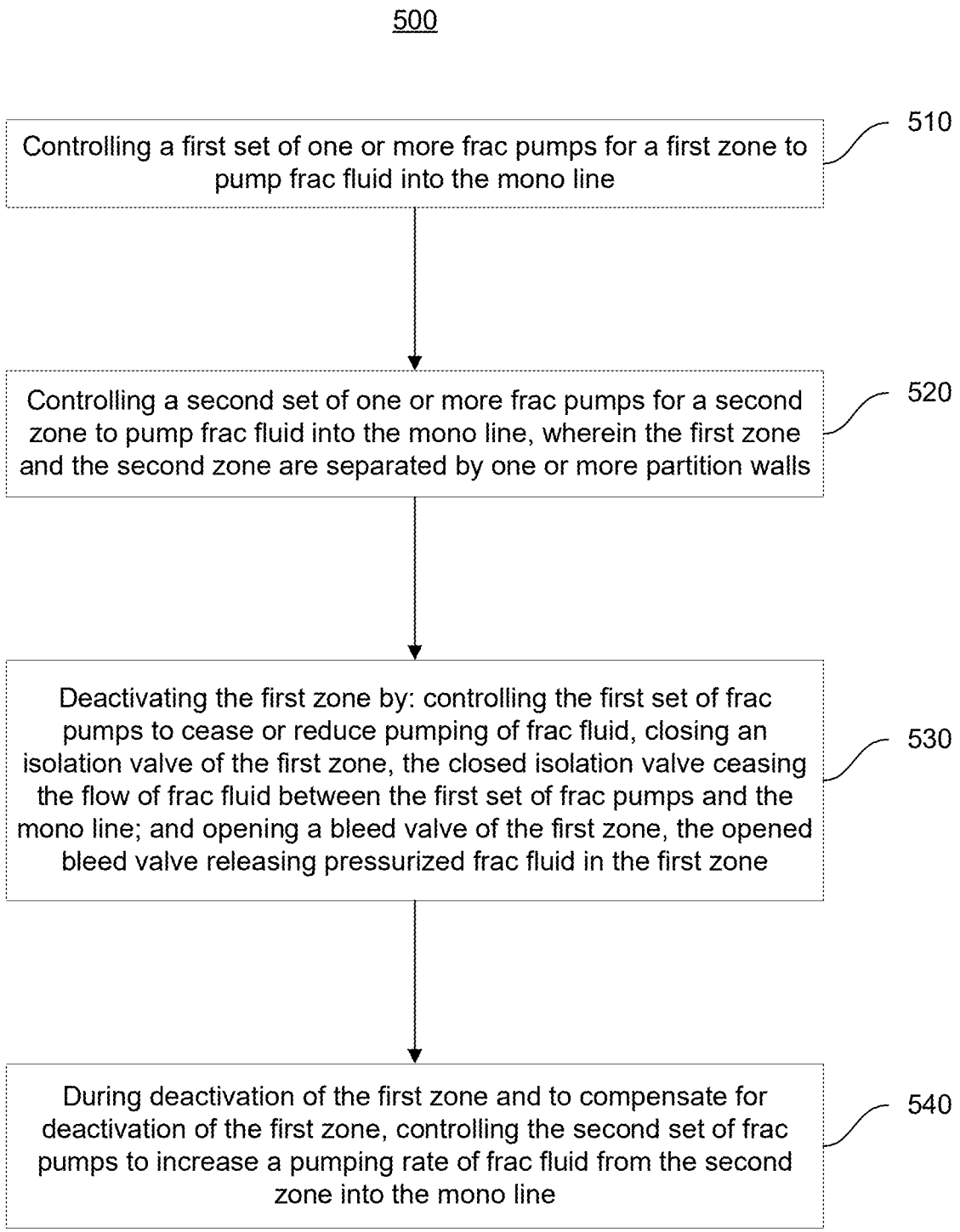
FIG. 5 is a flow chart illustrating a process for operating a compartmentalized frac system, in accordance with one or more embodiments.

FIG. 5. is a flowchart for a method 500 for operating a compartmentalized frac system, in accordance with one or more embodiments. The example method of FIG. 5 is performed from the perspective of a control system (e.g., 400), however this is not required. The method can include additional, fewer, or different steps than described. Additionally, the steps can be performed in different order, or by different components than described herein.

FIG. 5 is a flowchart of an example method for (e.g., remotely) controlling (e.g., deactivating) a first zone of a set of zones of a compartmentalized hydraulic fracturing (frac) system, the compartmentalized frac system comprising a mono line configured to carry frac fluid into a wellbore.

At step 510, the control system controls a first set of one or more frac pumps for a first zone to pump (e.g., high-pressure) frac fluid into the mono line.

At step 520, the control system (e.g., in conjunction with controlling the first set of frac pumps) controls a second set of one or more frac pumps for a second zone to pump frac fluid into the mono line, wherein the first zone and the second zone are separated by one or more partition walls.

At step 530, the control system deactivates the first zone by: controlling the first set of frac pumps to cease or reduce pumping of frac fluid, closing an (e.g., high-pressure) isolation valve of the first zone, the closed isolation valve ceasing the flow of frac fluid between the first set of frac pumps and the mono line; and opening a (e.g., high-pressure) bleed valve of the first zone, the opened bleed valve releasing pressurized frac fluid in the first zone.

At step 540, the control system, during deactivation of the first zone and to compensate for deactivation of the first zone, controls the second set of frac pumps to increase a pumping rate of frac fluid from the second zone into the mono line.

In some aspects, the method further includes: reactivating the first zone by: responsive to completion of a reactivation condition, controlling the first set of frac pumps to begin or increase pumping frac fluid; subsequent to completion of a priming condition of the first zone, closing the bleed valve; controlling the first set of frac pumps to adjust the frac fluid pressure in the first zone to a target pressure based on the frac fluid pressure in the mono line; and subsequent to the frac fluid pressure in the first zone reaching the target pressure, opening the isolation valve, the opened isolation valve enabling the flow of frac fluid between the set of frac pumps and the mono line; and during reactivation of the first zone and to compensate for reactivation of the first zone, controlling the second set of frac pumps to decrease the pumping rate of frac fluid from the second zone into the mono line.

In some aspects, the method further includes controlling a blender transport to pump frac fluid into a (e.g., low-pressure) second line configured to carry (e.g., low-pressure) frac fluid from the blender transport to the first set of one or more frac pumps; and wherein deactivating the first zone further includes: (e.g., after the pumps cease pumping and after the (e.g., high-pressure) isolation valve is closed) closing a second (e.g., low-pressure) isolation valve at the second line, the second isolation valve configured to control the flow of frac fluid between the blender transport and the first set of frac pumps; and (e.g., in conjunction with opening of the (e.g., high-pressure) bleed valve) opening a (e.g., low-pressure) second bleed valve configured to release pressurized frac fluid in a segment of the second line between the second isolation valve and the first set of one or more frac pumps.

Other aspects include components, devices, systems, improvements, methods, processes, applications, computer readable mediums, and other technologies related to any of the above.

Computing Machine Architecture

Figure 6:
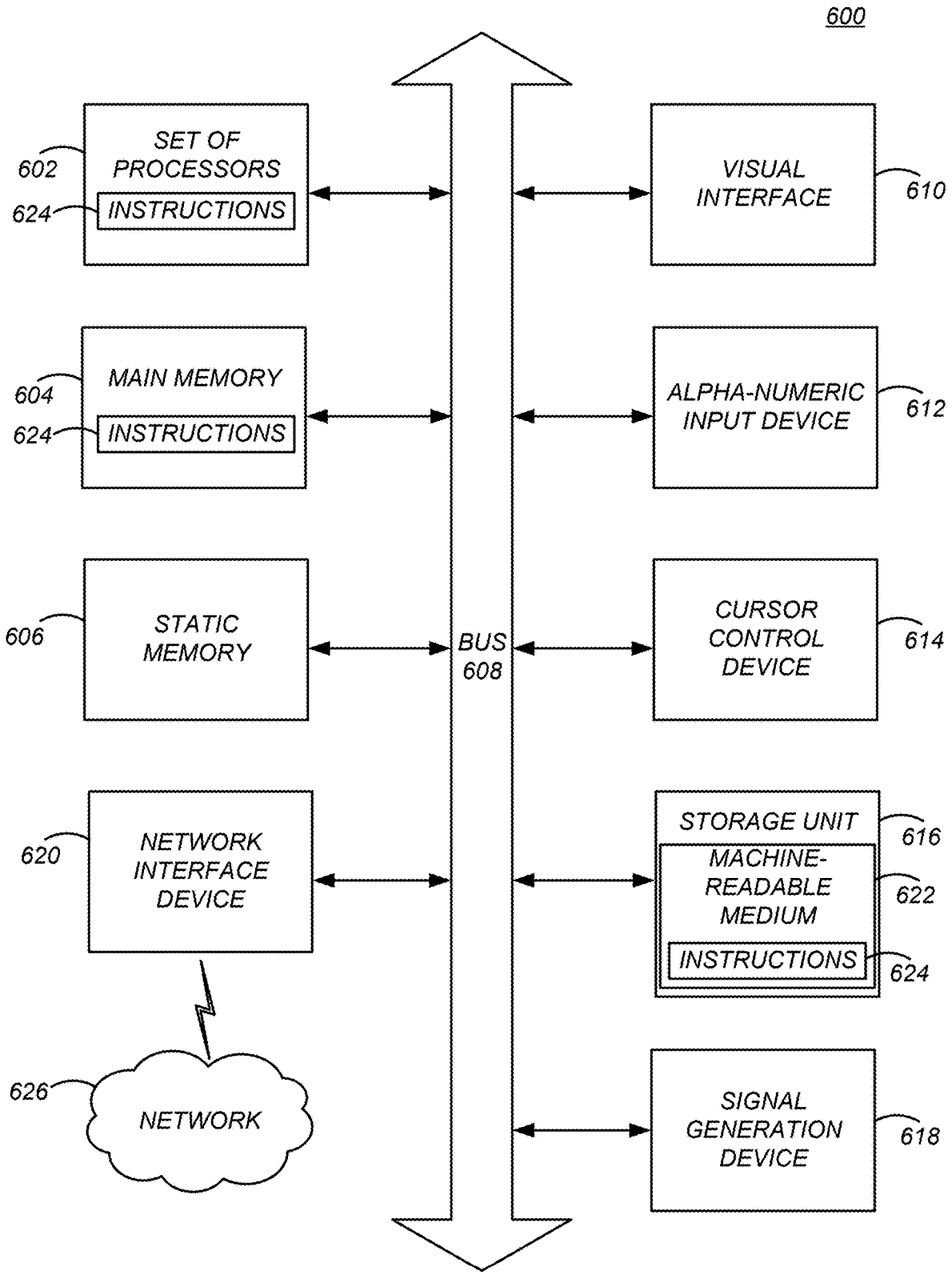
FIG. 6 is a block diagram illustrating components of an example machine able to read instructions from a machine-readable medium and execute them in a processor (or controller).

FIG. 6 is a block diagram illustrating components of an example machine able to read instructions from a machine-readable medium and execute them in a set of one or more processors (or controllers). Specifically, FIG. 6 shows a diagrammatic representation of a machine in the example form of a computer system 600 within which program code (e.g., software) for causing the machine to perform any one or more of the methodologies discussed herein may be executed. The program code may be comprised of instructions 624 executable by one or more processors 602. In alternative embodiments, the machine operates as a stand-alone device or may be connected (e.g., networked) to other machines. In a networked deployment, the machine may operate in the capacity of a server machine or a client machine in a server-client network environment, or as a peer machine in a peer-to-peer (or distributed) network environment. Control systems of compartmentalized frac systems described herein (e.g., 400) may be a computer system 600, part of a computer system 600, or include a computer system 600.

The machine may be a server computer, a client computer, a personal computer (PC), a tablet PC, a set-top box (STB), a personal digital assistant (PDA), a cellular telephone, a smartphone, a web appliance, a network router, switch or bridge, or any machine capable of executing instructions 624 (sequential or otherwise) that specify actions to be taken by that machine. Further, while only a single machine is illustrated, the term "machine" shall also be taken to include any collection of machines that individually or jointly execute instructions 624 to perform any one or more of the methodologies discussed herein.

The example computer system 600 includes a set of one or more processors 602 (e.g., one or more central processing units (CPUs), one or more graphics processing units (GPUs), one or more neural network processors (NNPs), one or more state machines, one or more digital signal processors (DSPs), one or more application specific integrated circuits (ASICs), one or more radio-frequency integrated circuits (RFICs), or any combination of these), a main memory 604, and a static memory 606, which are configured to communicate with each other via a bus 608. If the set of processors 602 includes multiple processors, the processors may operate individually or collectively to accomplish one or more operations. The computer system 600 may further include visual display interface 610. The visual interface may include a software driver that enables displaying user interfaces on a screen (or display). The visual interface may display user interfaces directly (e.g., on the screen) or indirectly on a surface, window, or the like (e.g., via a visual projection unit). For ease of discussion the visual interface may be described as a screen. The visual interface 610 may include or may interface with a touch enabled screen. The computer system 600 may also include alphanumeric input device 612 (e.g., a keyboard or touch screen keyboard), a cursor control device 614 (e.g., a mouse, a trackball, a joystick, a motion sensor, or other pointing instrument), a storage unit 616, a signal generation device 618 (e.g., a speaker), and a network interface device 620, which also are configured to communicate via the bus 608.

The storage unit 616 includes a (e.g., non-transitory) machine-readable medium 622 on which is stored instructions 624 (e.g., software) embodying any one or more of the methodologies or functions described herein. The instructions 624 (e.g., software) may also reside, completely or at least partially, within the main memory 604 or within the processor 602 (e.g., within a processor's cache memory)

during execution thereof by the computer system 600, the main memory 604 and the processor 602 also constituting machine-readable media. The instructions 624 (e.g., software) may be transmitted or received over a network 626 via the network interface device 620.

While machine-readable medium 622 is shown in an example embodiment to be a single medium, the term "machine-readable medium" should be taken to include a single medium or multiple media (e.g., a centralized or distributed database, or associated caches and servers) able to store instructions (e.g., instructions 624). The term "machine-readable medium" shall also be taken to include any medium that is capable of storing instructions (e.g., instructions 624) for execution by the machine and that cause the machine to perform any one or more of the methodologies disclosed herein. The term "machine-readable medium" includes, but not be limited to, data repositories in the form of solid-state memories, optical media, and magnetic media.

Additional Configuration Considerations

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like.

Furthermore, it has also proven convenient at times, to refer to these arrangements of operations as modules, without loss of generality. The described operations and their associated modules may be embodied in software, firmware, hardware, or any combinations thereof.

Throughout this specification, some embodiments have used the expression "coupled" along with its derivatives. The term "coupled" is not necessarily limited to two or more elements being in direct physical or electrical contact. Rather, the term "coupled" may also encompass two or more elements that are not in direct contact with each other, but yet still co-operate or interact with each other.

The terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability. Any computing systems including multiple processors may operate the multiple processors individually or collectively.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A compartmentalized hydraulic fracturing (frac) system comprising:

a mono line configured to carry frac fluid into a well;

a plurality of zones, each zone comprising:

a set of one or more frac pumps each configured to pump frac fluid into the mono line;

an isolation valve configured to control the flow of frac fluid between the set of frac pumps and the mono line; and a bleed valve configured to release pressurized frac fluid from the set of frac pumps when in an open position;

partition walls between the plurality of zones; and a control system configured to deactivate or reactivate a zone of the plurality of zones by controlling the set of frac pumps, the isolation valve, and the bleed valve of the zone.

2. The compartmentalized frac system of claim 1, wherein to reactivate a zone of the plurality of zones, the control system is configured to:

activate the set of frac pumps;

subsequent to completion of a priming condition, closing the bleed valve;

control the set of frac pumps to adjust the frac fluid pressure to a target pressure based on frac fluid pressure in the mono line; and subsequent to the frac fluid pressure reaching the target pressure, open the isolation valve to connect the zone to the mono line.

3. The compartmentalized frac system of claim 2, wherein to reactivate a zone of the plurality of zones, the control system is further configured to:

prior to controlling the set of frac pumps to adjust the frac fluid pressure to the target pressure, control the set of frac pumps to increase the frac fluid pressure to a second target pressure based on a maintenance condition for the zone, wherein the second target pressure is higher than the target pressure.

4. The compartmentalized frac system of claim 2, wherein the control system is further configured to:

ramp down other zones in conjunction with opening the isolation valve.

5. The compartmentalized frac system of claim 1, wherein to deactivate a zone of the plurality of zones, the control system is configured to:

deactivate the set of frac pumps;

close the isolation valve to isolate the zone from the mono line; and open the bleed valve.

6. The compartmentalized frac system of claim 5, wherein to deactivate a zone of the plurality of zones, the control system is further configured to:

ramp up other zones in conjunction with closing the isolation valve.

7. The compartmentalized frac system of claim 1, wherein the control system is configured to remotely deactivate or reactivate the zone based on sensor data from a sensor coupled to a component of the zone.

8. The compartmentalized frac system of claim 1, wherein the control system is further configured to:

receive sensor data generated by a sensor coupled to a component a zone of the plurality of zones;

analyze the sensor data;

determine, based on the sensor data analysis, a service condition is met; and automatically begin deactivation of the zone.

9. The compartmentalized frac system of claim 1, wherein the control system is further configured to individually deactivate or reactivate any zone of the plurality of zones.

10. The compartmentalized frac system of claim 1, wherein the control system is configured to begin a deactivation of a zone of the plurality of zones responsive to receiving a user instruction to deactivate the zone.

11. The compartmentalized frac system of claim 1, wherein each zone further comprises:

a second line configured to carry frac fluid from a blender transport to the set of one or more frac pumps;

a second isolation valve at the second line and configured to control the flow of frac fluid between the blender transport and the set of frac pumps; and a second bleed valve configured to release pressurized frac fluid in a segment of the second line between the second isolation valve and the set of one or more frac pumps when in an open position.

12. The compartmentalized frac system of claim 11, wherein to reactivate a zone of the plurality of zones, the control system is configured to:

close the second bleed valve;

open the second isolation valve;

activate the set of frac pumps;

subsequent to completion of a priming condition, closing the bleed valve;

control the set of frac pumps to adjust the frac fluid pressure to a target pressure based on frac fluid pressure in the mono line; and subsequent to the frac fluid pressure reaching the target pressure, open the isolation valve to connect the zone to the mono line.

13. A compartmentalized hydraulic fracturing (frac) system comprising:

frac pumps each configured to pump frac fluid into a mono line, wherein the frac pumps are divided into zones, each zone including a set of one or more of the frac pumps;

partition walls between the zones;

isolation valves for the zones, each isolation valve of a zone configured to control the flow of frac fluid between the set of frac pumps and the mono line;

bleed valves for the zones, each bleed valve of a zone configured to release pressurized frac fluid in a zone to a bleed tank; and a control system configured to deactivate or reactivate each zone of the compartmentalized frac system by controlling the frac pumps, the isolation valves, and the bleed valves of each zone.

14. The compartmentalized frac system of claim 13, wherein to reactivate a zone of the zones, the control system is configured to:

activate frac pumps of the zone;

subsequent to completion of a priming condition, closing a bleed valve of the zone;

control the frac pumps of the zone to adjust the frac fluid pressure to a target pressure based on frac fluid pressure in the mono line; and subsequent to the frac fluid pressure reaching the target pressure, open an isolation valve of the zone to connect the zone to the mono line.

15. The compartmentalized frac system of claim 14, wherein to reactivate a zone of the zones, the control system is further configured to:

prior to controlling the frac pumps of the zone to adjust the frac fluid pressure to the target pressure, control the frac pumps of the zone to increase the frac fluid pressure to a second target pressure based on a maintenance condition for the zone, wherein the second target pressure is higher than the target pressure.

16. The compartmentalized frac system of claim 14, wherein the control system is further configured to:

ramp down other zones in conjunction with opening the isolation valve of the zone.

17. The compartmentalized frac system of claim 13, wherein to deactivate a zone of the zones, the control system is configured to:

deactivate the frac pumps of the zone;

close an isolation valve of the zone to isolate the zone from the mono line; and open a bleed valve of the zone.

18. The compartmentalized frac system of claim 17, wherein to deactivate the zone the control system is further configured to:

ramp up other zones in conjunction with closing the isolation valve of the zone.

19. The compartmentalized frac system of claim 13, wherein the control system is configured to remotely deactivate or reactivate a zone of the zones based on sensor data from a sensor coupled to a component of the zone.

20. The compartmentalized frac system of claim 13, wherein the control system is further configured to:

receive sensor data generated by a sensor coupled to a component of a zone;

analyze the sensor data;

determine, based on the sensor data analysis, a service condition is met; and automatically begin deactivation of the zone of the zones.

* * * * *